US007681508B2

(12) United States Patent
Taniguchi et al.

(10) Patent No.: US 7,681,508 B2
(45) Date of Patent: Mar. 23, 2010

(54) AFTER-AIR NOZZLE FOR TWO-STAGE COMBUSTION BOILER, AND A TWO-STAGE COMBUSTION BOILER, BOILER AND COMBUSTION METHOD USING THE SAME

(75) Inventors: Masayuki Taniguchi, Tokyo (JP); Kenji Yamamoto, Tokyo (JP); Hirofumi Okazaki, Tokyo (JP); Kazumi Yasuda, Tokyo (JP); Kenji Kiyama, Hiroshima (JP); Takanori Yano, Hiroshima (JP); Akira Baba, Hiroshima (JP)

(73) Assignee: Babcock-Hitachi K.K., Tokyo (JP)

( * ) Notice: Subject to any disclaimer, the term of this patent is extended or adjusted under 35 U.S.C. 154(b) by 358 days.

(21) Appl. No.: 11/263,035

(22) Filed: Nov. 1, 2005

(65) Prior Publication Data

US 2006/0090677 A1 May 4, 2006

(30) Foreign Application Priority Data

Nov. 2, 2004 (JP) ..... 2004-318996
Dec. 9, 2004 (JP) ..... 2004-356394

(51) Int. Cl.
*F23B 5/00* (2006.01)

(52) U.S. Cl. ..... 110/214; 110/210; 110/348

(58) Field of Classification Search ..... 110/348, 110/150, 157, 214, 210
See application file for complete search history.

(56) References Cited

U.S. PATENT DOCUMENTS 2,695,599 A * 11/1954 Armacost ..... 122/479.6
4,520,739 A * 6/1985 McCartney et al. ..... 110/263
5,727,480 A * 3/1998 Garcia-Mallol ..... 110/203

FOREIGN PATENT DOCUMENTS

| | | | |
|---|---|---|---|
| JP | 58-000003 | | 1/1983 |
| JP | 64-38418 | | 3/1989 |
| JP | 9-310807 | | 2/1997 |
| JP | 09-112878 | | 5/1997 |
| JP | 09-303742 | | 11/1997 |
| JP | 0809068 | A2 * | 11/1997 |
| JP | 9-310807 | | 12/1997 |
| JP | 09310807 | A * | 12/1997 |
| JP | 10-122546 | | 5/1998 |
| JP | 10-153302 | | 6/1998 |
| JP | 2002-340328 | | 11/2002 |

(Continued)

OTHER PUBLICATIONS

Australian Official Report dated Mar. 27, 2007.
Chinese Office Action dated Apr. 4, 2008, along with English translation.
Canadian Office Action dated Oct. 3, 2008.

(Continued)

*Primary Examiner*—Kenneth B Rinehart
(74) *Attorney, Agent, or Firm*—Crowell & Moring LLP

(57) ABSTRACT

An after-air nozzle capable of reducing NOx and CO and a boiler equipped with such a nozzle are provided The after-air nozzle has a vena contracta such that an outside diameter of a flow passage diminishes towards the air-jetting port which supplies air to a boiler, and a changing apparatus changes a flow passage cross-sectional area of the vena contracta. A method of use of such an after-air nozzle and a boiler so equipped is also provided.

14 Claims, 24 Drawing Sheets

FOREIGN PATENT DOCUMENTS

| | | |
|---|---|---|
| JP | 2003-254510 | 9/2003 |
| WO | WO 03/067143 | 8/2003 |
| WO | WO 03/067153 | 8/2003 |
| WO | WO 03/067153 A1 | 8/2003 |

OTHER PUBLICATIONS

English Translation of Japanese Patent Office Action dated Apr. 24, 2009, corresponding to Japanese Application No. 2004-318996.

English Translation of Japanese Patent Office Action dated Apr. 24, 2009, corresponding to Japanese Application No. 2004-356394.

* cited by examiner

FIG. 4
CUTAWAY VIEW OF SECTION A-A'
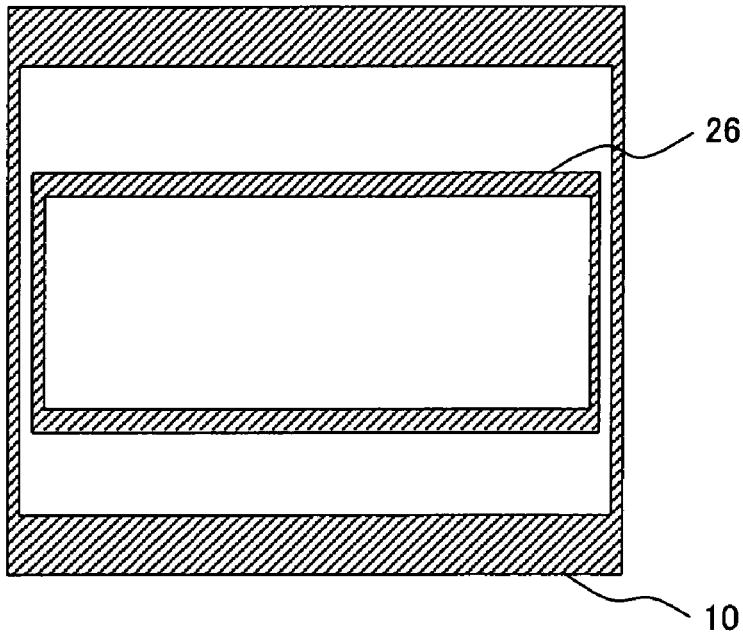
CUTAWAY VIEW OF SECTION B-B'
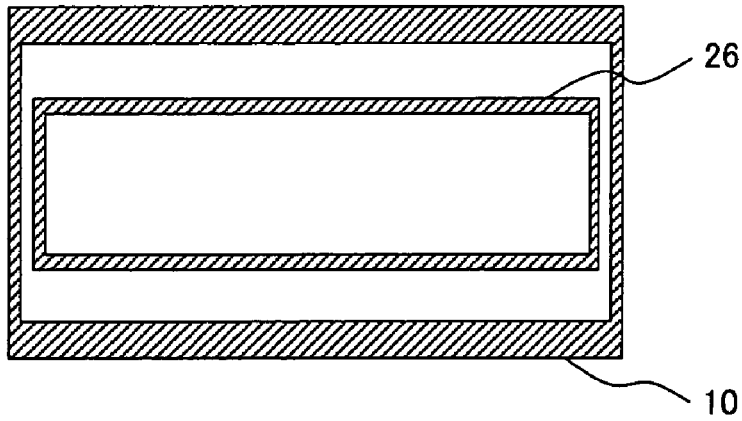

FIG. 15

BURNER AIR RATIO, FURNACE AIR RATIO:
REFERENCE CONDITIONS ± 2%

| | | |
|---|---|---|
| 101 | □ | PRESENT INVENTION (CONTRACTION, VARIABLE IN FLOW PASSAGE AREA) |
| 102 | + | CONTRACTION NOZZLE 1, FIXED IN FLOW PASSAGE AREA |
| 103 | × | CONTRACTION NOZZLE 2, FIXED IN FLOW PASSAGE AREA |
| 104 | ○ | RECTILINEAR NOZZLE 2, VARIABLE IN FLOW PASSAGE AREA (BORE DIAMETER) |
| 105 | △ | RECTILINEAR/ ROTARY NOZZLE, FIXED IN FLOW PASSAGE AREA (BORE DIAMETER) |
| 106 | ● | RECTILINEAR NOZZLE 1, FIXED IN FLOW PASSAGE AREA (BORE DIAMETER) |

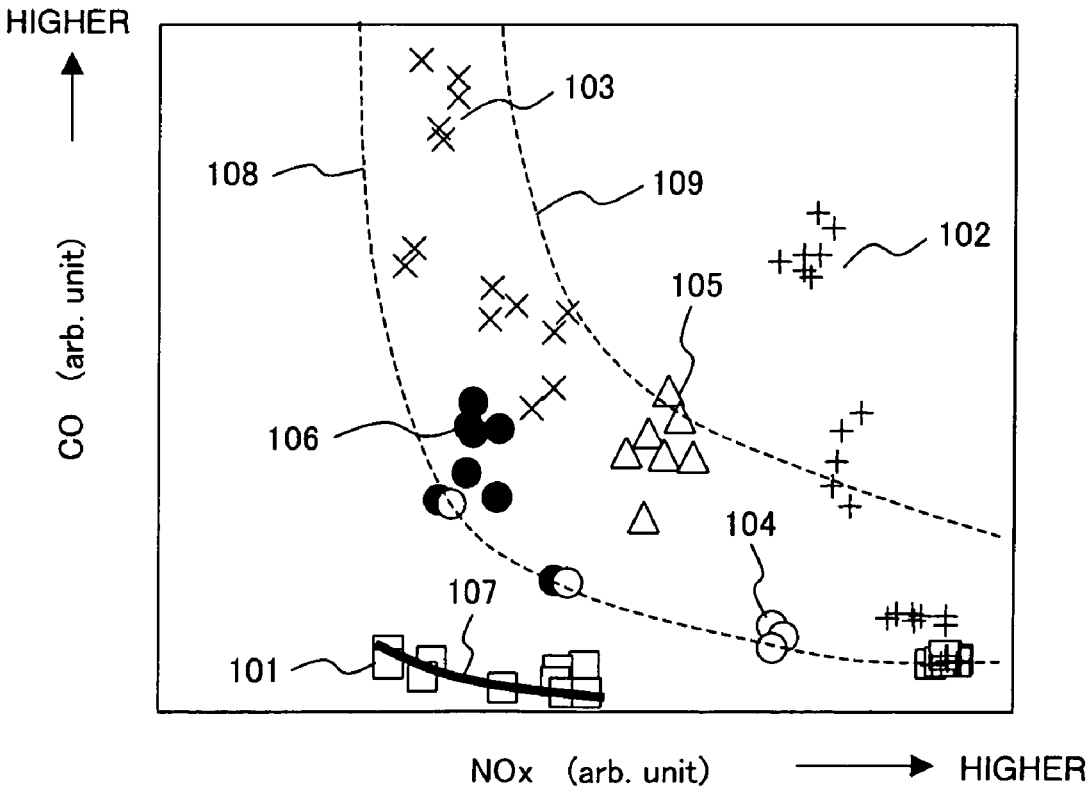

AFTER-AIR NOZZLE FOR TWO-STAGE COMBUSTION BOILER, AND A TWO-STAGE COMBUSTION BOILER, BOILER AND COMBUSTION METHOD USING THE SAME

CLAIM OF PRIORITY

The present application claims priority from Japanese application serial No. 2004-318996, filed on Nov. 2, 2004, and Japanese application serial No. 2004-356394, filed on Dec. 9, 2004, the contents of which are hereby incorporated by references into this application.

BACKGROUND OF THE INVENTION

1. Field of the Invention

The present invention relates to an after-air nozzle for a two-stage combustion boiler, and to a structure of a two-stage combustion boiler using the after-air nozzle.

2. Prior Art

Boilers are required to reduce the concentrations of nitrogen oxides (NOx), and a two-stage combustion method is applied to meet this requirement. In this method, a fuel is burnt under a state of air shortage and then air for complete combustion is supplied from an after-air nozzle. For the after-air nozzle, several structures are proposed for improved fuel-air mixture and combustion states.

For example, as illustrated in FIG. 1 of Patent Reference 1 (Japanese Laid-Open Patent Application Publication No. Hei 10-122546), a structure is proposed that has a vena contracta with its air flow passage outside diameter progressively diminished towards an air-jetting port, in an after-air nozzle. However, although recent boilers are required to reduce NOx and carbon oxide (CO) concentrations at the same time, conventional constructions have only been able to reduce either NOx or CO emissions.

Patent Reference 1: Japanese Laid-Open Patent Application Publication No. Hei 10-122546

SUMMARY OF THE INVENTION (Problems to be Solved by the Invention)

An object of the present invention is to provide a structure of an after-air nozzle capable of reducing NOx and CO concentrations at the same time.

(Means for Solving the Problem)

One means for solving the problem described above is by providing, in an after-air nozzle for a two-stage combustion boiler, a vena contracta with an air flow passage outside diameter progressively diminished towards an air-jetting port formed for supplying air to the boiler, and flow passage area-changing means for changing a flow passage area of the vena contracta.

(Effects of the Invention)

Using the after-air nozzle of the present invention makes it possible to reduce NOx and CO concentrations at the same time in a two-stage combustion boiler.

BRIEF DESCRIPTION OF THE DRAWINGS

FIG. 4 is another sectional view taken along line A-A' in the after-air nozzle of FIG. 1;

FIG. 15 shows verification experimental results on advantageous effects of the present invention;

DETAILED DESCRIPTION OF THE INVENTION

Description of the Preferred Embodiments

Structures of and usage methods for an after-air nozzle according to the present invention will be described below using the accompanying drawings.

First Embodiment

Figure 1:
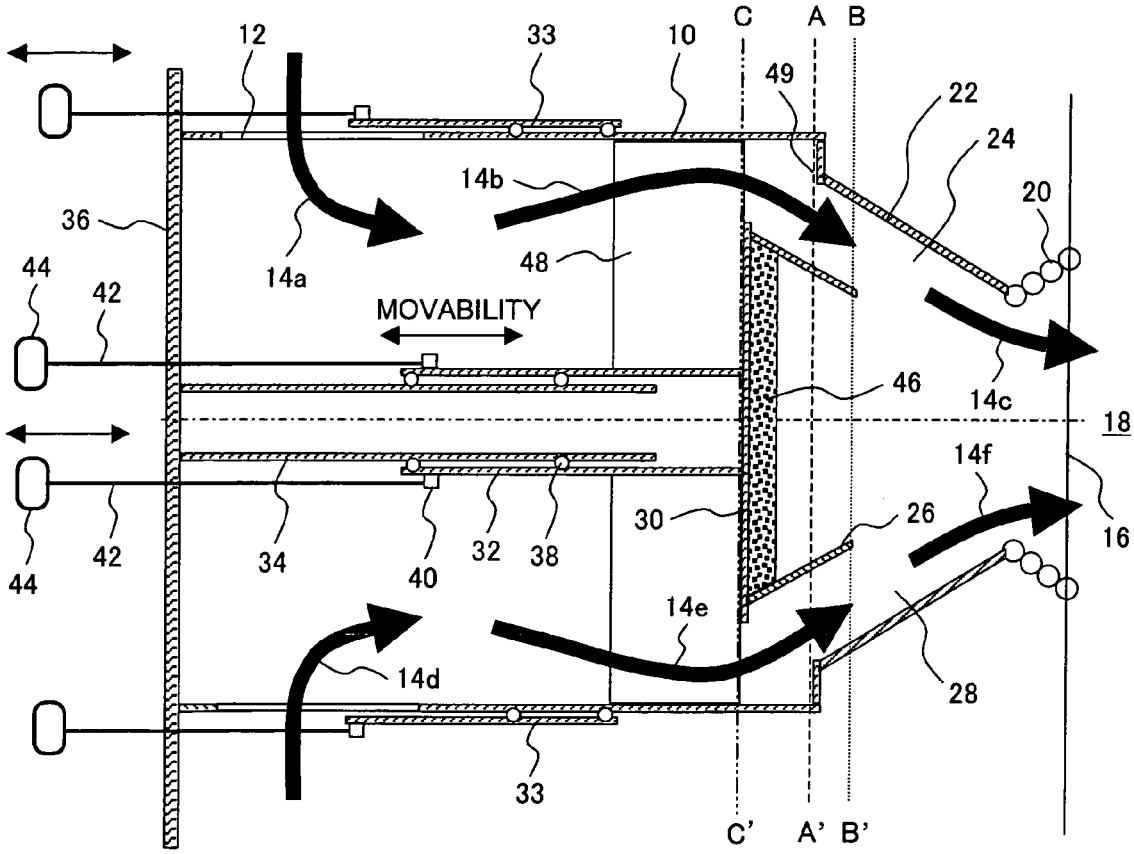
FIG. 1 is a longitudinal cutaway view of an after-air nozzle, showing a first embodiment of the present invention.

FIG. 1 is a longitudinal cutaway view showing an embodiment of an after-air nozzle according to the present invention. The after-air nozzle is surrounded by a windbox outer casing 10, and air for combustion flows in from openings 12 provided in rear portions of the windbox outer casing 10. Streams of air, 14*a* to 14*f*, circulate along arrows and are jetted from a jetting port 16 into an in-furnace combustion space 18. The jetted air is mixed with a flammable gas in the in-furnace combustion space 18, thus burning the flammable gas. Water tube 20 is provided around the jetting port 16. A contraction member 22 is provided at the side of the after-air nozzle that faces the jetting port 16. The contraction member 22 has a bore diameter progressively diminished towards the jetting port 16.

A velocity component for a flow towards a central axis of the nozzle is assigned to each of the arrow-marked streams of air, 14*a* to 14*f*, by the contraction member 22, and thus a vena contracta 24 is formed. A member 26 defining a minimum flow passage area of the vena contracta 24 is provided near an entrance thereof. A velocity of the air in the vena contracta 24 is defined by an area of a minimum flow passage 28 within the vena contracta 24. In the construction that FIG. 1 shows, the minimum flow passage 28 of the vena contracta 24 is formed at a front end of the member 26 defining the minimum flow passage area of the vena contracts 24.

The member 26 defining the minimum flow passage area of the vena contracta 24 in FIG. 1 is constructed so that an outside diameter of the member 26 is gradually diminished towards the jetting port 16. This construction minimizes any disturbances of the streams inside the vena contracta 24. Fewer disturbances make it easier to suppress sudden increases of NOx.

The member 26 defining the minimum flow passage area of the vena contracta 24 is secured to a support member 30 provided to support the member 26. The support member 30 for supporting the member 26 is secured to a slide ring 32. The slide ring 32 is installed in an inner casing 34. The slide ring 32 and the inner casing 34 are not fixed to each other, and the slide ring 32 is movable in a direction of a windbox outer wall 36 of FIG. 1 or in a direction of the jetting port 16.

Moving the slide ring 32 also moves both the support member 30 that supports the member 26 defining the minimum flow passage area of the vena contracta 24, and the member 26 itself at the same time. The movement of the member 26 defining the minimum flow passage area of the vena contracta 24 changes the minimum flow passage 28 of the vena contracta 24 in area. At this time, the vena contracta 24 changes in inside diameter, with an outside diameter remaining fixed. This change, in turn, changes a flow passage cross-sectional area of the vena contracta 24, namely, a cross-sectional area vertical to the central axis of the nozzle.

As described later in this Specification, NOx and CO concentrations can be simultaneously reduced by providing the vena contracta 24 whose air flow passage outside diameter is diminished towards the air-jetting port 16, and adjusting the flow passage area without changing the flow passage outside diameter. Installing guide rollers 38 on either the slide ring 32 or the inner casing 34 makes the slide ring 32 movable smoothly. The member 26 defining the minimum flow passage area of the vena contracta 24 can be moved from the outside (left in FIG. 1) of the windbox outer wall 36 by connecting slide ring moving rod immobilizers 40, slide ring moving rods 42, and handles 44 to the slide ring 32.

Changing an area of the windbox opening 12 by installing a slide ring 33 on the windbox outer casing 10 makes it possible to change the total amount of air flowing into the after-air nozzle. If the total amount of air inflow is unnecessary or can be changed using any other method, the slide ring 33 does not need to be installed on the windbox outer casing 10.

An overheat-preventing material 46 is provided inside the member 26 defining the minimum flow passage area of the vena contracta 24. Thus, the support member 30 for supporting the member 26 defining the minimum flow passage area of the vena contracta 24 is protected from thermal damage due to the radiant heat emitted from a flame formed in the in-furnace combustion space 18. The overheat-preventing material 46 is not always necessary if the radiant heat from the flame formed in the in-furnace combustion space 18 is sufficiently weak or if the support member 30 can be cooled using any other method.

Installing a guide 48 on the slide ring 33 prevents the member 26 defining the minimum flow passage area of the vena contracta 24, from easily becoming misaligned when the slide ring 32 is moved. The installation also provides rigid securing between the slide ring 32 and the member 26 defining the minimum flow passage area of the vena contracta 24. In addition, the streams of air are easily guided. The guide 48 has an inner end fixed to the outside of the slide ring 32, and an outer end brought into contact with an inner surface of the windbox outer casing 10 so as to be slidable.

A positional relationship between the member 26 defining the minimum flow passage area of the vena contracta 24, and the contraction member 22, during longitudinal movement of the member 26, will be described below. The description of the relationship in position takes a starting position (A-A' cross section in FIG. 1) of the vena contracta 24 as a reference. When the member 26 is moved as far as it can go in the direction of the jetting port 16, the front end of the member 26 is positioned externally to the starting position of the vena contracta 24 so as to be closer to the jetting port 16. At this time, the guide 48 has its movement limited by a stepped portion 49 provided at a connection between the vena contracta 24 and the windbox outer casing. 10. Conversely, when the member 26 is moved as far as it can go in the direction of the windbox outer wall 36, the front end of the member 26 is positioned internally to the starting position of the vena contracta 24 so as to be closer to the windbox outer wall 36. Although an actual moving range can be different from the above, the later-described experiments by the present inventors indicate that NOx and CO concentrations can be simultaneously reduced most easily in the moving range discussed above.

Figure 2:
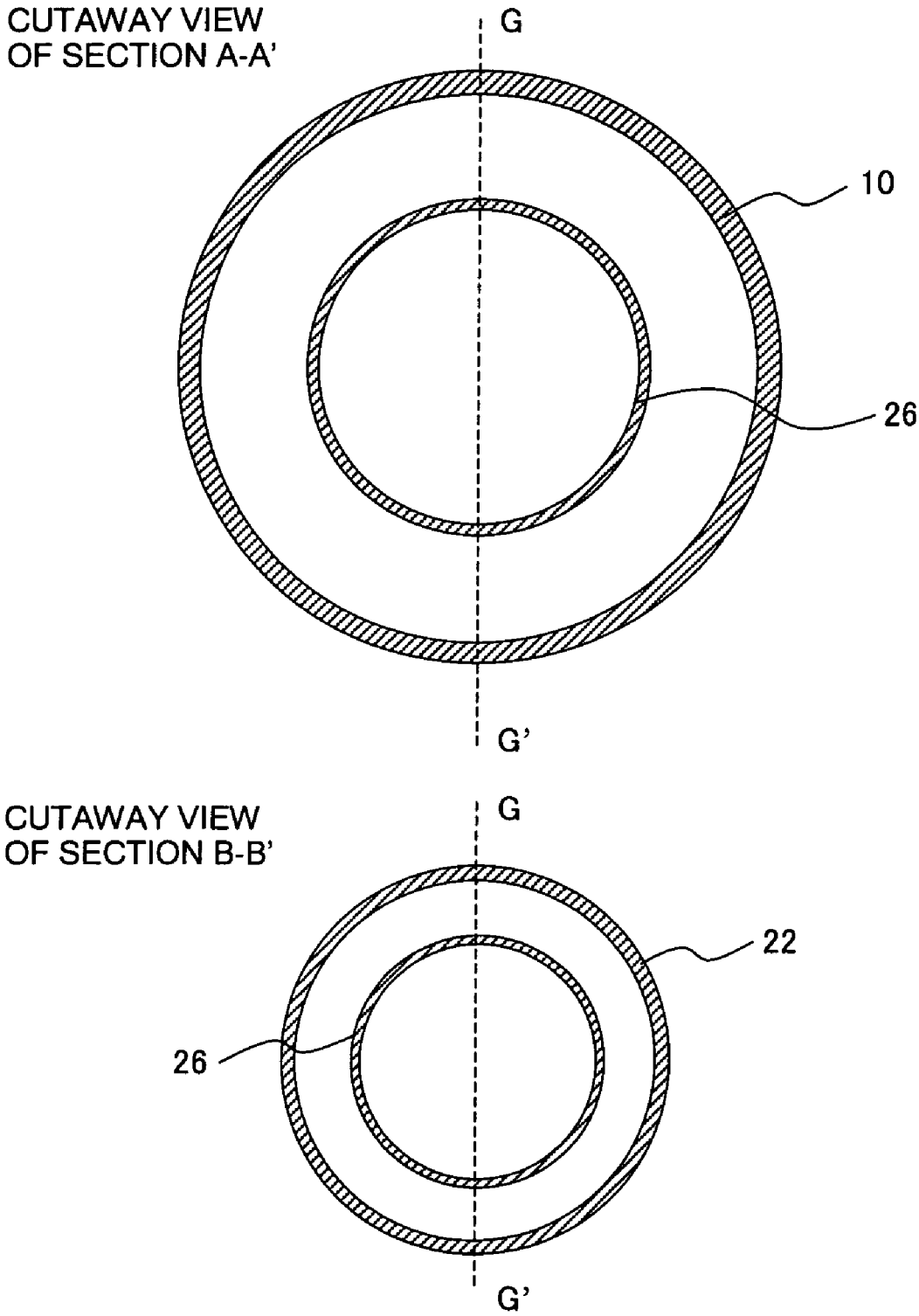
FIG. 2 is a sectional view taken along line A-A' in the after-air nozzle of FIG. 1.
Figure 3:
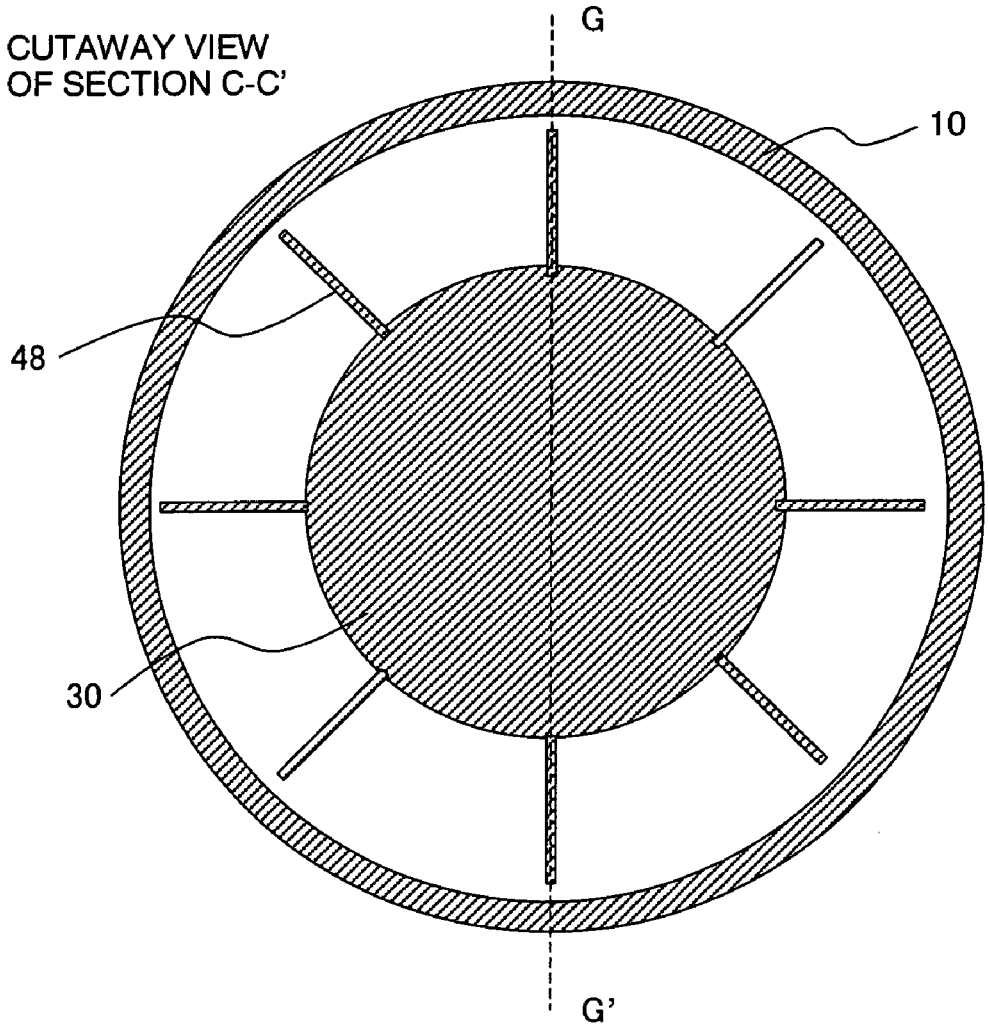
FIG. 3 is a sectional view taken along line C-C' in the after-air nozzle of FIG. 1.

Cutaway views of sections A-A' and B-B' in the nozzle of FIG. 1 are shown in FIG. 2, and a cutaway view of section C-C' in the nozzle is shown in FIG. 3. FIG. 1 is equivalent to cutaway views of section G-G' in FIGS. 2 and 3. FIG. 4 is a variation of the cutaway views of sections A-A' and B-B' in FIG. 1. While a nozzle having a circular sectional shape was used in the later-described experiments by the present inventors, equivalent advantageous effects can likewise be anticipated by using such a rectangular nozzle as shown in FIG. 4.

Figure 5:
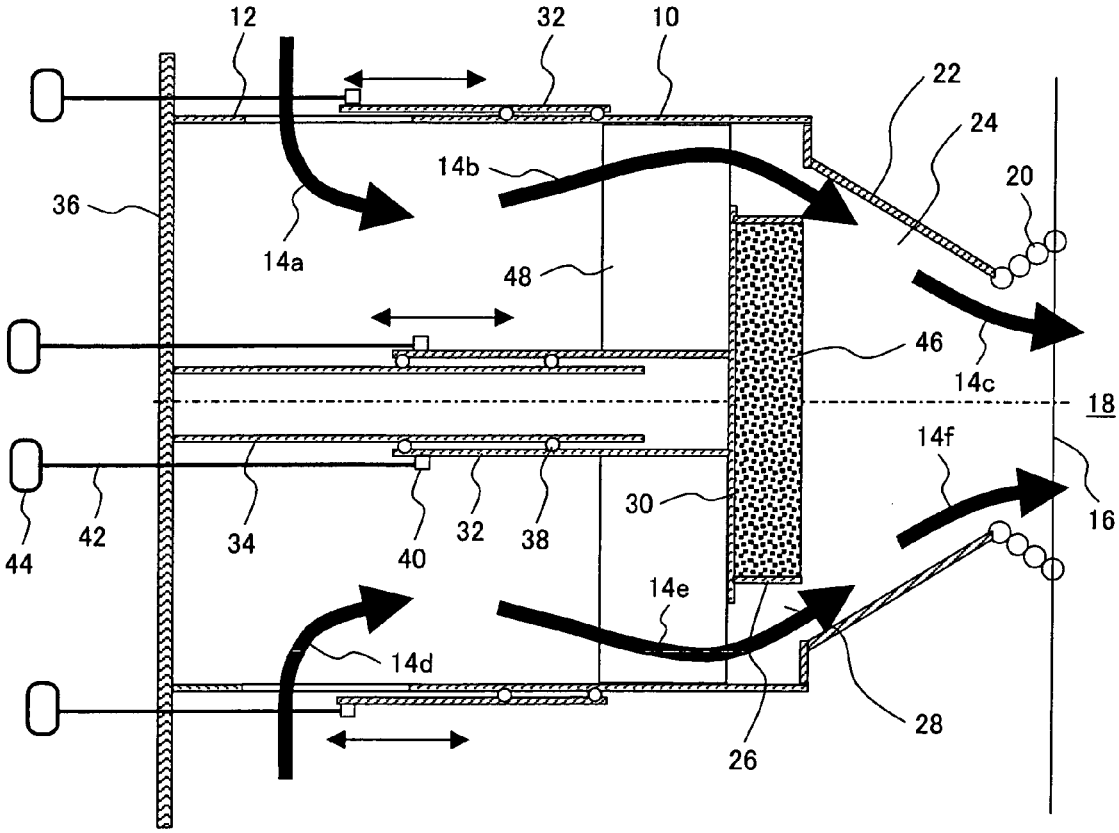
FIG. 5 is a longitudinal cutaway view of an after-air nozzle, illustrating a variation of the first embodiment of the present invention that is shown in FIG. 1.

FIG. 5 is a longitudinal cutaway view of an after-air nozzle, illustrating a variation of the first embodiment of the present invention that is shown in FIG. 1. This variation differs from the embodiment of FIG. 1 in a shape of a member 26 defining a minimum flow passage area of a vena contracta 24. More specifically, although the member 26 and material 46 in FIG. 1 have an outer peripheral surface progressively thinned down as it becomes closer to the in-furnace combustion space 18, outer peripheral surfaces of the equivalent member and material shown in FIG. 5 are parallel to each other and flat. A requirement of the member 26 in FIG. 5 is to allow a minimum flow passage 28 of the vena contracta 24 to be changed in area by moving the member. Only if this requirement is satisfied, the member can take such a shape as shown in FIG. 5.

Second Embodiment

Figure 6:
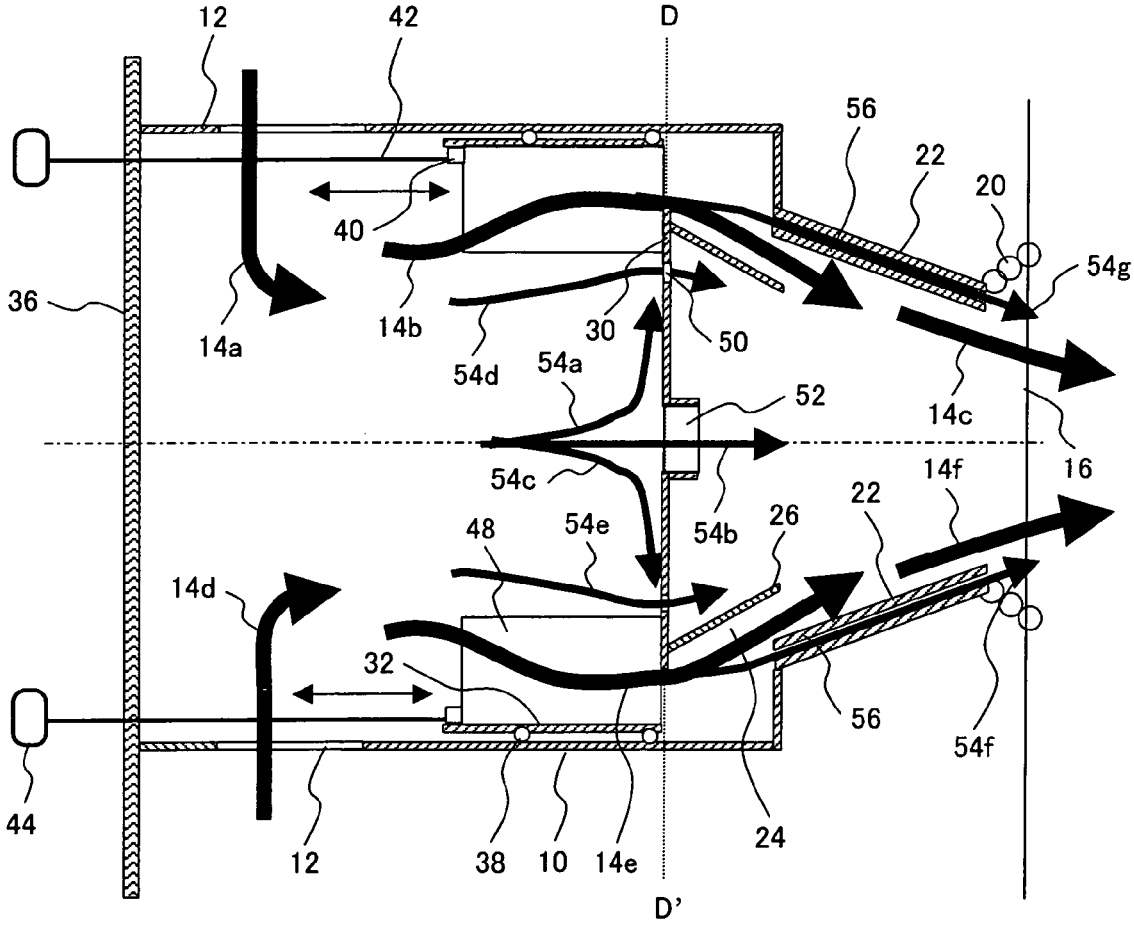
FIG. 6 is a longitudinal cutaway view showing a second embodiment of an after-air nozzle according to the present invention.

FIG. 6 is a longitudinal cutaway view showing a second embodiment of an after-air nozzle according to the present invention. The present embodiment differs from the embodiment of FIG. 1 in that the nozzle does not have an inner casing 34 intended to move a member 26 defining a minimum flow passage area of a vena contracts 24, and in that the nozzle has a cooling air flow passage for cooling both a support member 30 provided for the member 26 defining the minimum flow passage area of the vena contracta 24, and the vena contracts 24 itself. Although other constituent elements each assigned the same reference number as in FIG. 1 will not be described, it is to be understood that each such element has the same function as in FIG. 1.

A slide ring 32 is movably installed inside a windbox outer casing 10. The present embodiment is the same as that of FIG. 1, in that the slide ring 32 is moved via slide ring moving rod immobilizers 40, slide ring moving rods 42, and handles 44, and in that the slide ring 32 can be easily moved by installing guide rollers 38. In the construction that FIG. 6 shows, since air can be introduced into the slide ring 32, it is possible to introduce the air needed to cool the support member 30 for the member 26 defining the minimum flow passage area of the vena contracta 24.

The member 26 defining the minimum flow passage area of the vena contracta 24 can be moved in a longitudinal direction of the member 26, as in FIG. 1. Although a contraction member 22 and the member 26 defining the minimum flow passage area of the vena contracts 24 differ in angle, since a minimum flow passage 28 of the vena contracta 24 can be changed in area without changing the vena contracta in outside diameter, NOx/CO reduction performance equivalent to that achievable in FIG. 1 can be anticipated. The support member 30 for supporting the member 26 defining the minimum flow passage area of the vena contracts 24 is formed with cooling air holes 50, 52.

Part of the air streams 14*a*, 14*d* that have been introduced from windbox openings 12 is released from the cooling air hole 52 as a cooling air stream 54*a*-54*c*. During this process, the cooling air stream 54*a*-54*c* impinges on the support member 30 for supporting the member 26 defining the minimum flow passage area of the vena contracta 24, and can thus cool the member 30. The air streams 54*d*, 54*e* that have been released from the cooling air holes 50 also impinge on the member 26 defining the minimum flow passage area of the vena contracta 24, and can thus cool the member 26.

Additionally, a cooling air guide plate 56 is provided in vicinity of the vena contracta 24. Between the cooling air guide plate 56 and the contraction member 26, cooling air 54*f*, 54*g* flows to allow the contraction member 22 to be cooled. Since the cooling air 54*f*, 54*g* flows along the outermost peripheral side of a jetting port 16, the cooling air 54*f*, 54*g* can also be used to remove any coal ashes sticking to a periphery of the contraction member 26.

Figure 7:
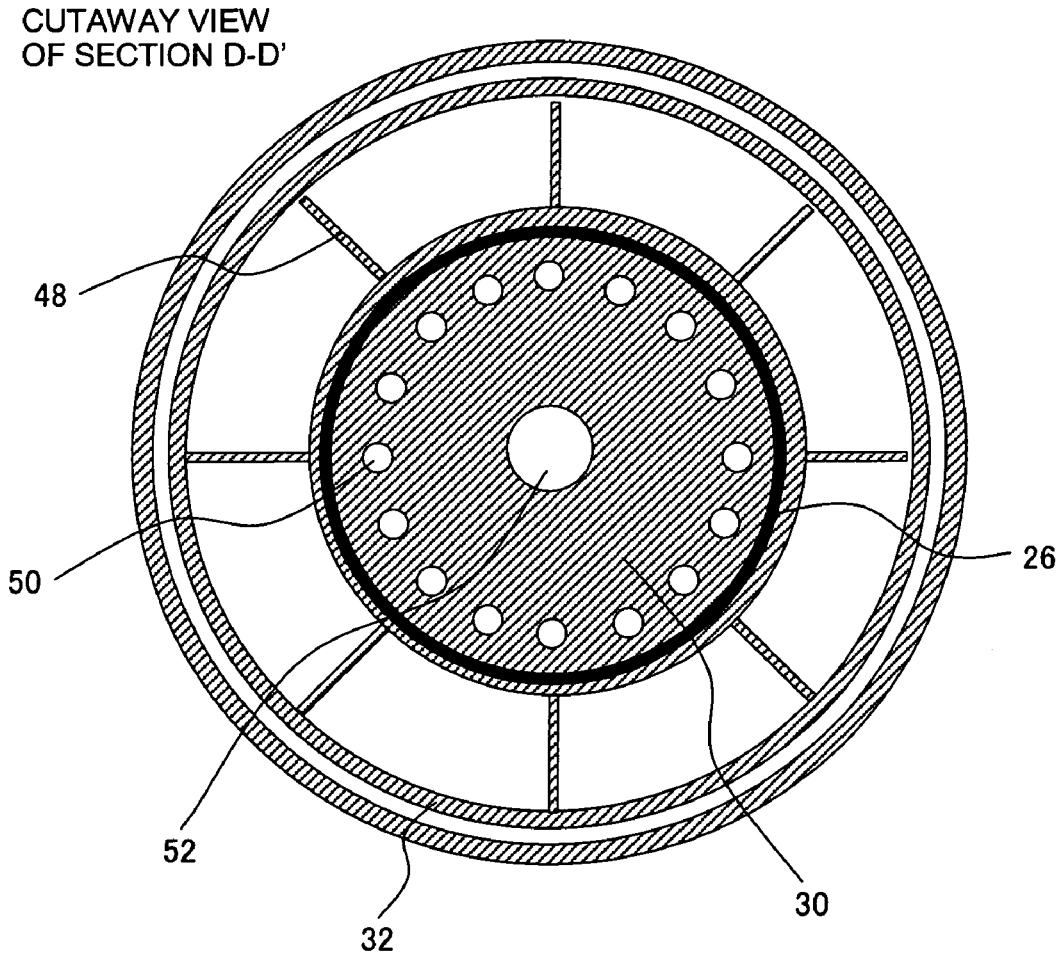
FIG. 7 is a longitudinal cutaway view taken along line D-D' in FIG. 6.
Figure 8:
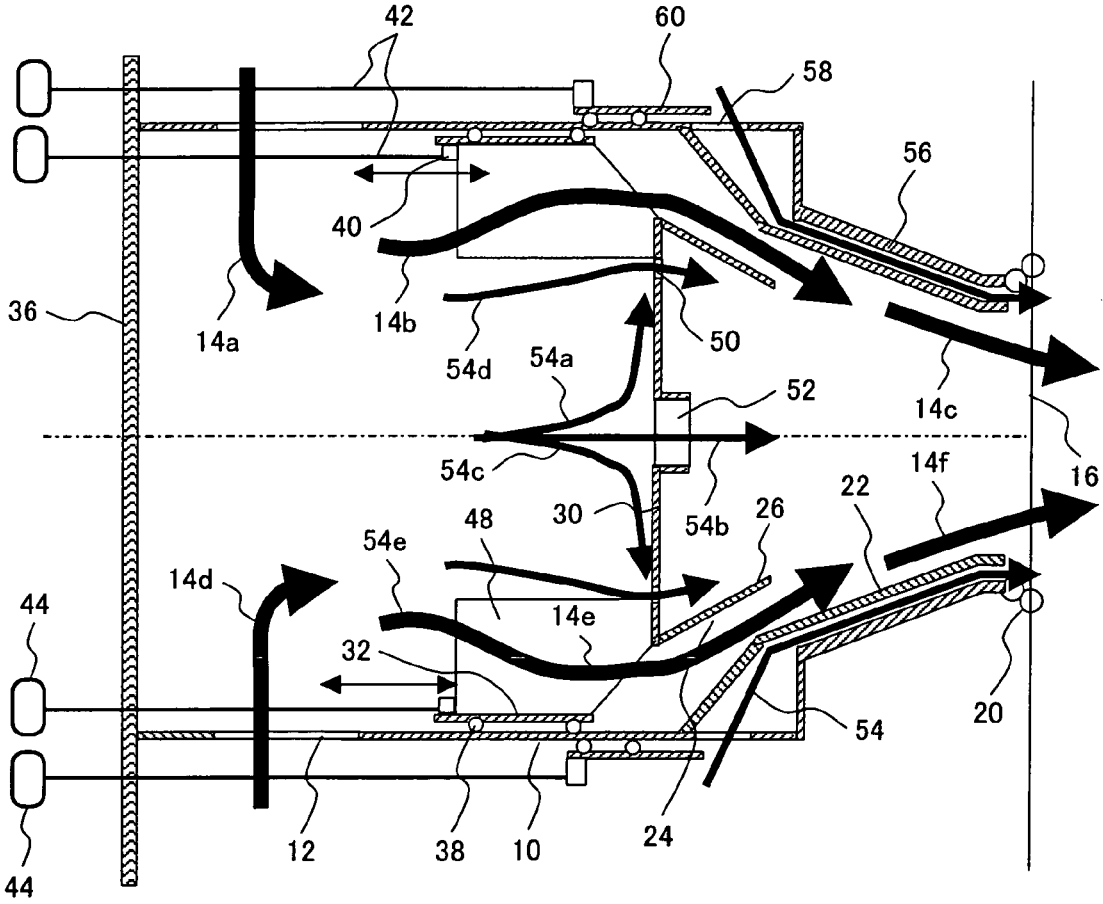
FIG. 8 is a longitudinal cutaway of an after-air nozzle structure, showing a variation of the second embodiment shown in FIG. 6.

FIG. 7 is a cutaway view of section D-D' in FIG. 6. The cooling air holes 50, 52 have a plurality of circular pores, slit-shaped openings, or the like. FIG. 7 shows an example in which a plurality of circular pores are provided. FIG. 8 is a variation of FIG. 6, showing a structure adapted to allow adjustment of a flow rate of air for cooling the contraction member 22. The windbox outer casing 10 has cooling air introduction ports 58. A movable guide sleeve 60 for adjusting the cooling air flow rate is provided around each cooling air introduction port 58, whereby the cooling air flow rate is adjusted.

When the jetting port 16 has its periphery heavily laden with coal ashes, the cooling air introduction ports 58 are particularly useful since the ashes can be easily removed by temporarily increasing the flow rate of the air between the contraction member 22 and the cooling air guide plate 56. The contraction member 22 can have its angle changed midway in the vena contracta 24. For reasons such as restrictions on manufacture of the nozzle, a shape of the guides 48 may be changed as in FIG. 8. In the construction that FIG. 8 shows, the vena contracta 24 has a large angle in neighborhood of its entrance and a small angle in the neighborhood of its exit. The guides 48 have a shape partially notched at outer periphery. Forming the guides 48 into the shape as shown in FIG. 8 is effective for reducing NOx, since disturbances in the air streams flowing into the vena contracta 24 can be minimized.

Third Embodiment

Figure 9:
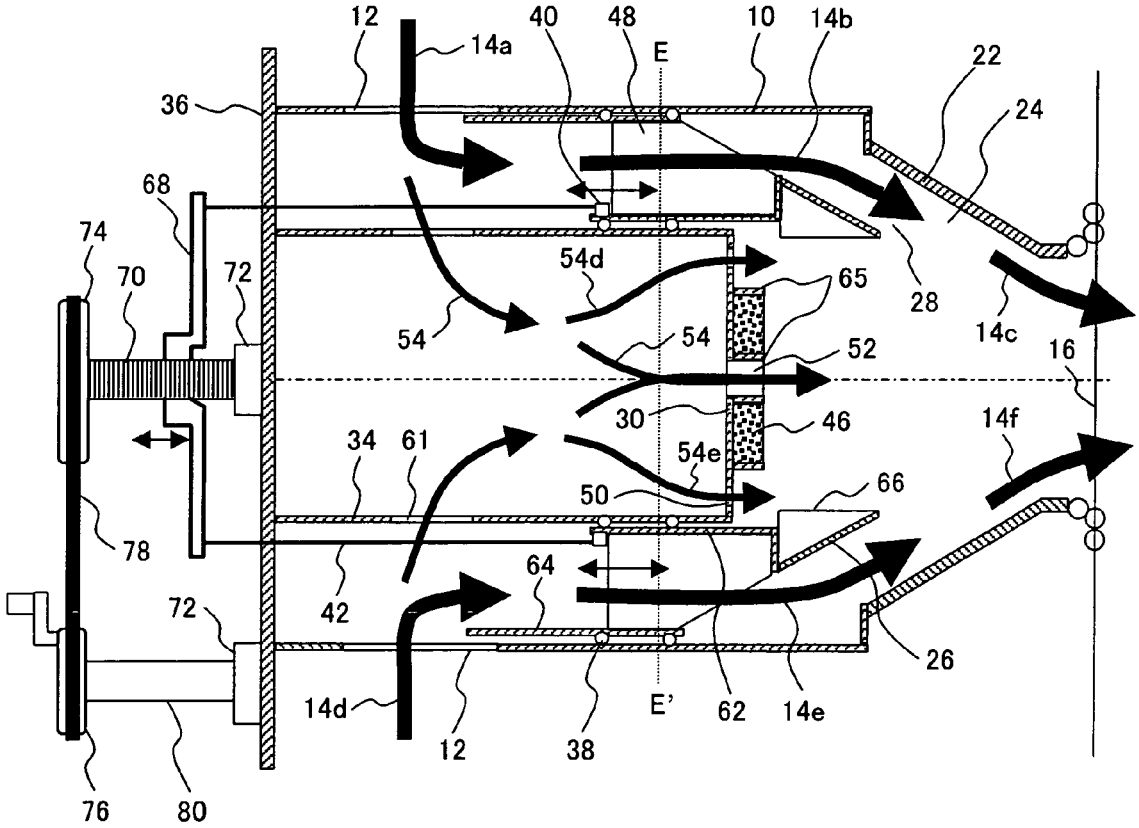
FIG. 9 is a sectional view showing a third embodiment of an after-air nozzle of the present invention.

FIG. 9 is a sectional view showing another embodiment of an after-air nozzle of the present invention. This nozzle of a construction with an inner casing 34 can introduce cooling air thereinto through air holes 61. A slide ring inner casing 62 is installed outside the inner casing 34, and a slide ring outer casing 64 is installed inside a windbox outer casing 10. The slide ring inner casing 62 and the slide ring outer casing 64 are connected at and fixed to guides 48. In this construction, movable sections can be reduced in weight.

In the construction of FIG. 9, an overheat-preventing material 46 interposed between support members 65 is provided at a portion of the side of the inner casing 34 that faces a jetting port 16. If the overheat-preventing material 46 is constructed using a ceramic refractory/heat-insulating member or the like, this correspondingly increases the inner casing 34 in weight, thus obstructing use of the heavy overheat-preventing material 46 for a movable section. In such construction as shown in FIG. 9, however, a member 26 defining a minimum flow passage area of a vena contracts can be moved without moving the overheat-preventing material 46. The member 26 defining the minimum flow passage area of vena contracta 24 has a cooling accelerator 66 and can thus be cooled with a minimum amount of air.

Slide ring moving rod immobilizers 40 and slide ring moving rods 42 are fixed to either the slide ring inner casing 62, the slide ring outer casing 64, or the guides 48 (in FIG. 9, the slide ring inner casing 62). A slide ring mover 68 is connected to the slide ring moving rods 42. Moving the slide ring mover 68 moves the member 26 that defines the minimum flow passage area of the vena contracta 24.

The slide ring mover 68 is further connected to a threaded rotating shaft 70. Rotating the threaded rotating shaft 70 moves the slide ring mover 68 in a direction of the jetting port 16 or in a direction of a windbox outer wall 36. A rotating-shaft bearing 72 is installed at one end of the threaded rotating shaft 70. A rotary panel 74 is installed at the other end.

The rotary panel 74 is connected to a rotating handle 76 via a belt or chain 78. Rotation of the rotating handle 76 rotates the rotary panel 74 as well. The rotating handle 76 is connected to a rotating shaft 80 so as to be rotatable smoothly. An advantage of this construction resides in that adjustment during combustion is easy. Reduction in NOx can be achieved by rotating the rotating handle 76 so that the member 26 for defining the minimum flow passage area of the vena contracta 24 moves in the direction of the jetting port 16. And reduction in CO can be achieved by rotating the rotating handle 76 in the reverse direction.

Part of the windbox openings 12 can be blocked by moving the slide ring outer casing 64. Thus, a constant flow rate of the air flowing in from the windbox openings 12 can be maintained, even when the member 26 that defines the minimum flow passage area of the vena contracta 24 is moved. If the flow passage area of the vena contracta 24 is reduced, flow passage resistance at this section increases and prevents the air from flowing smoothly.

In the construction of FIG. 9, however, at this time, the windbox openings 12 are increased in flow passage area, and consequently, the flow passage resistance occurring at this section is reduced. The reverse of this applies when the flow passage area of the vena contracta 24 is increased. That is to say, in total perspective of the after-air nozzle, when one section is increased in flow passage resistance, other sections are reduced in flow passage resistance.

Optimizing the windbox openings 12 in size and shape makes it possible to maintain constant flow passage resistance in the entire after-air nozzle, even when the flow passage area of the vena contracta 24 is changed. This construction, however, is not always necessary, if the air flow rate does not need to be kept constant or can be adjusted using any other method.

Figure 10:
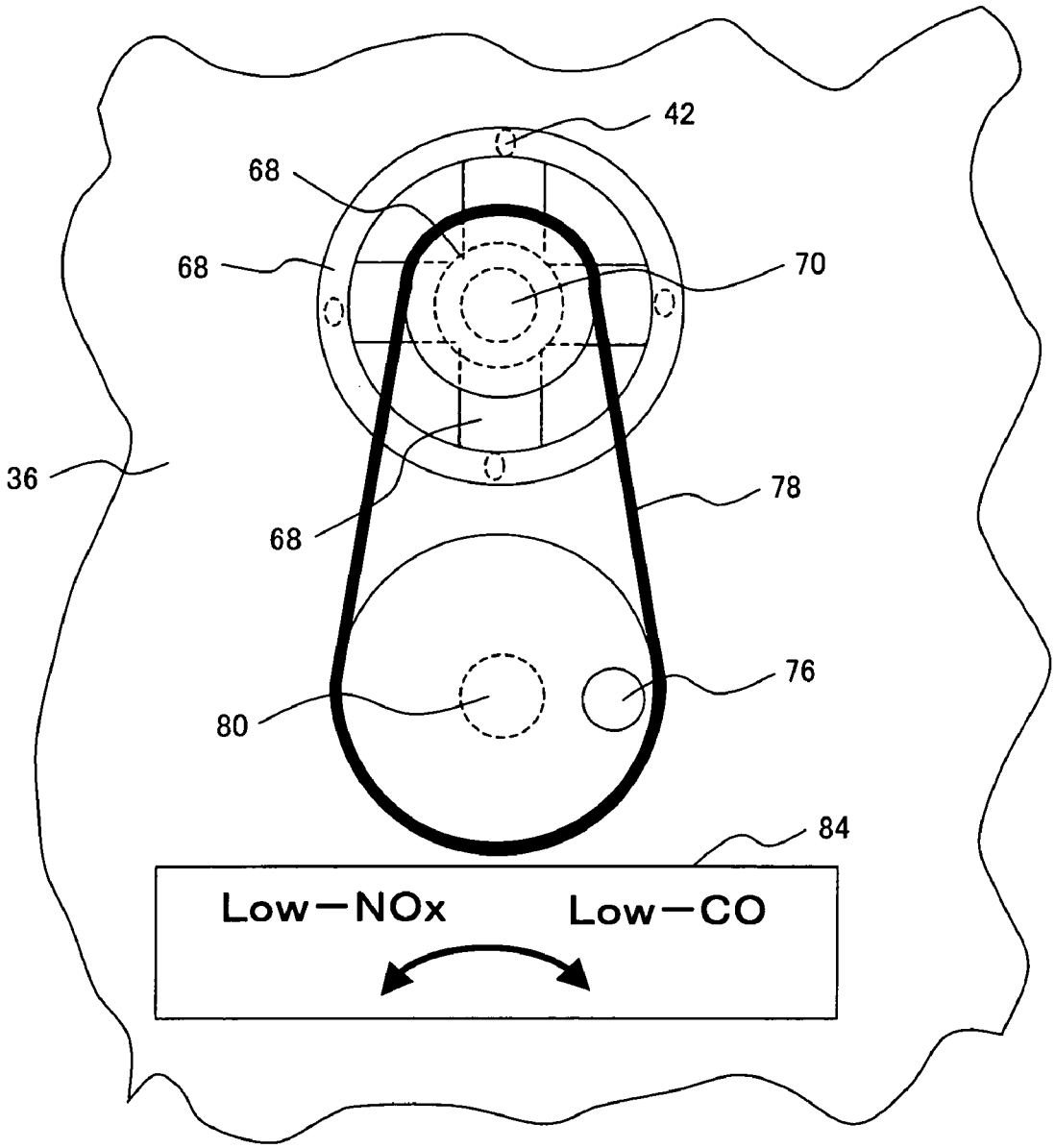
FIG. 10 is a view from the outside of an associated furnace, showing a controller in the after-air nozzle of FIG. 9.
Figure 11:
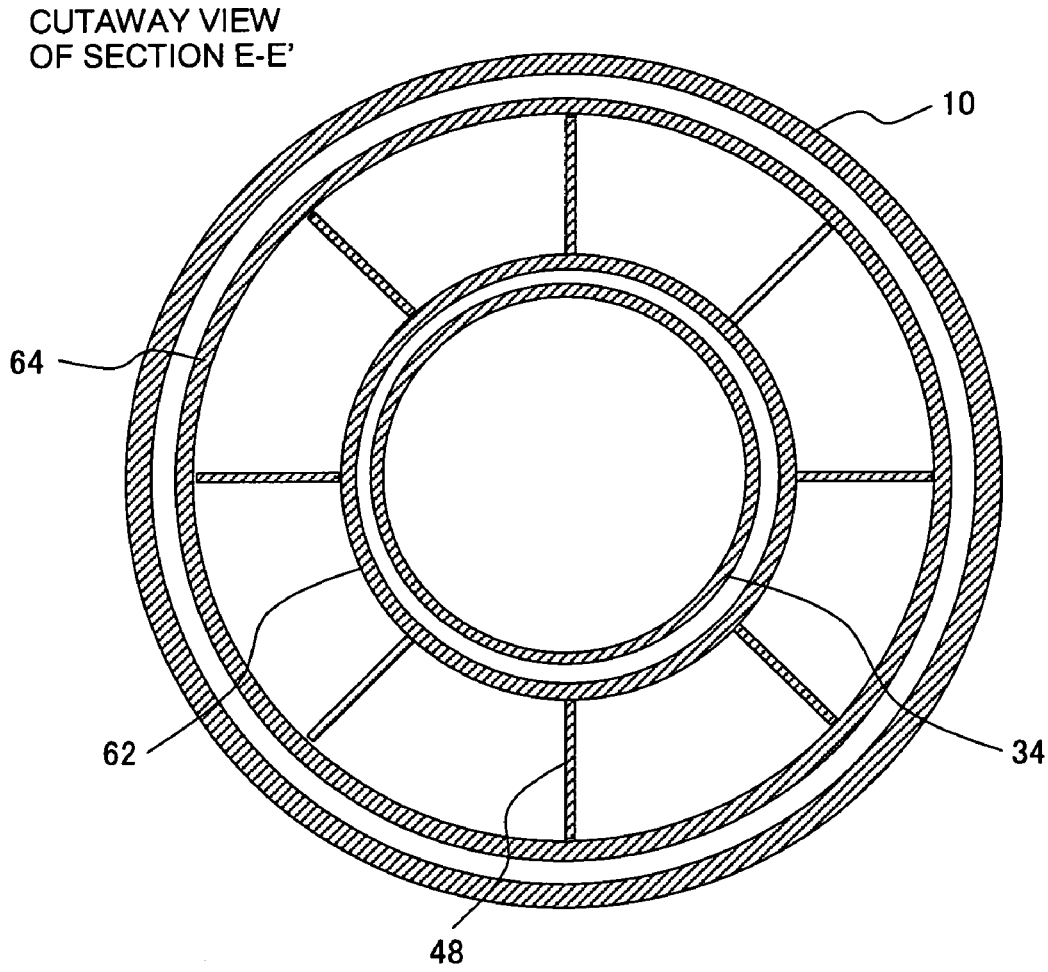
FIG. 11 is a longitudinal cutaway view taken along line E-E' in the after-air nozzle of FIG. 9.

FIG. 10 is a view from the windbox outer wall 36. A plate 84 is provided near the rotating handle, and rotational directions and the advantageous effects expected are inscribed on the plate 84. A relationship between operations and the effects expected is inscribed clearly and obviously in such a form as to be readily understandable. Even an unskilled operator, therefore, does not make mistakes in operations. FIG. 11 is a cutaway view of section E-E' in FIG. 9.

Fourth Embodiment

Figure 12:
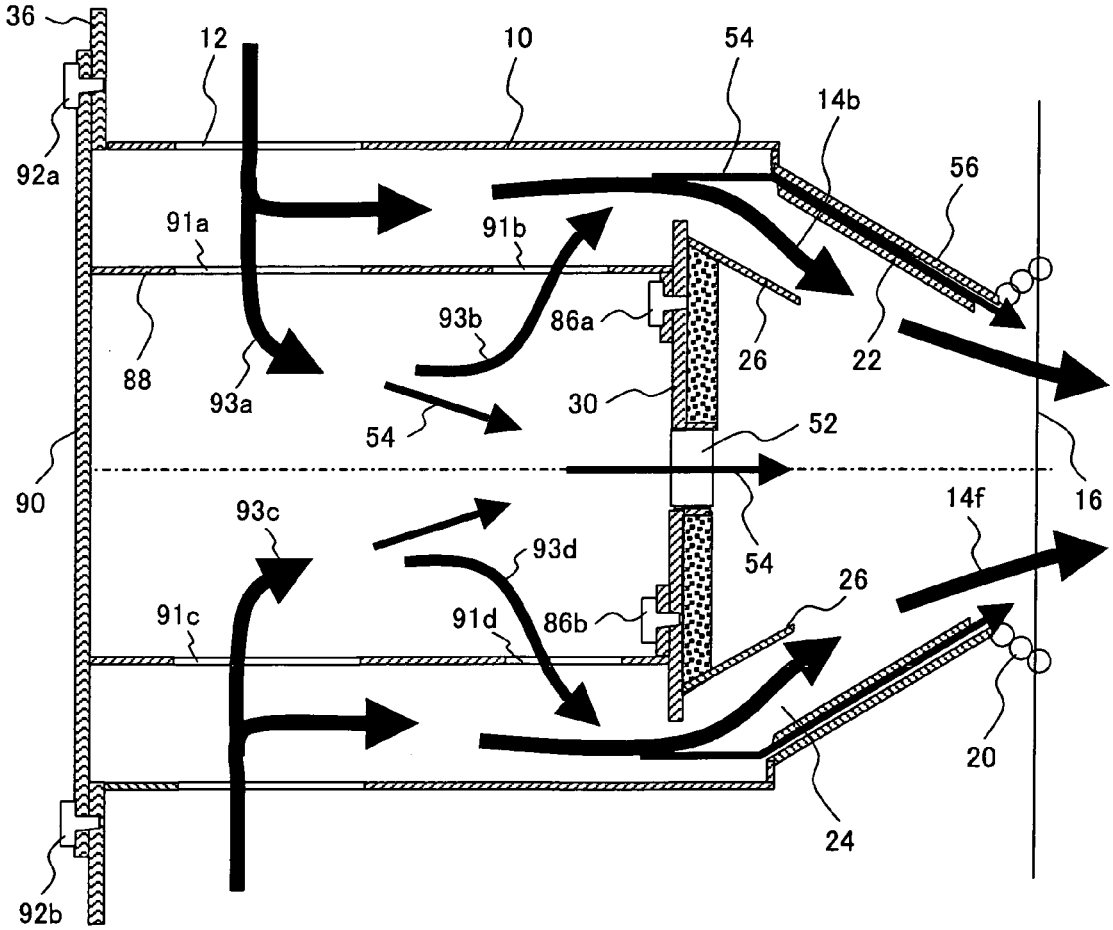
FIG. 12 is a longitudinal cutaway view showing a fourth embodiment of an after-air nozzle according to the present invention.

FIG. 12 is a longitudinal sectional view showing a further embodiment of an after-air nozzle according to the present invention.

A member 26 defining a minimum flow passage area of a vena contracta 24 is adapted to be replaceable. A support member 30 for the member 26 defining the minimum flow passage area of the vena contracta 24 is installed on a removable inner casing 88 via removable bolts 86*a*, 86*b*. The removable inner casing 88 is fixed to a removable windbox outer plate 90, which is installed on a windbox outer wall 36 via removable bolts 92*a*, 92*b*.

In this construction, the member 26 defining the minimum flow passage area of the vena contracta 24 can be replaced from the outside (in FIG. 12, left) of the windbox outer wall 36 by removing the bolts 86*a*, 86*b*. The minimum flow passage area of the vena contracta 24 can be readily and easily changed by having several members 26 at hand in advance and replacing the installed member 26 with one of those members 26. In the present embodiment, the removable inner casing 88 has air holes 91*a*, 91*b*, 91*c*, 91*d*, and streams of air, 93*a*, 93*b*, 93*c*, 93*d*, circulate through the air holes 91*a*, 91*b*, 91*c*, 91*d*, respectively.

Fifth Embodiment

Figure 13:
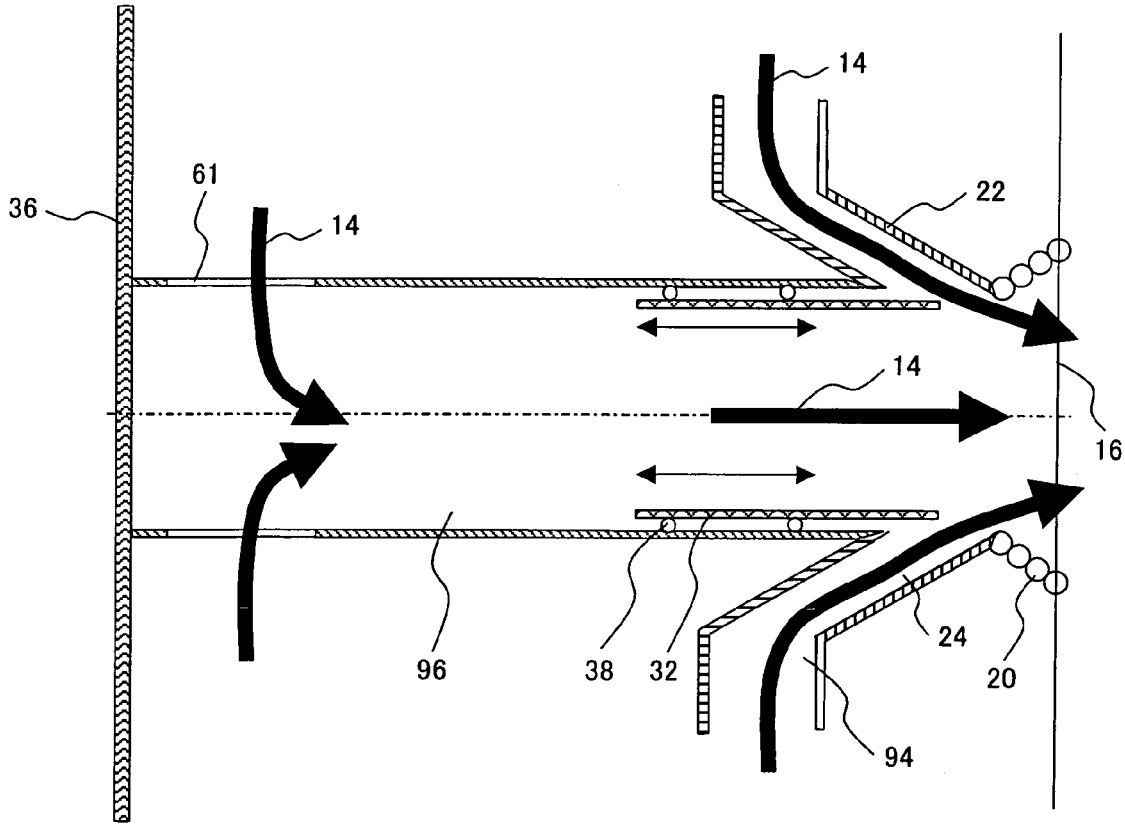
FIG. 13 is a longitudinal cutaway view showing a fifth embodiment of an after-air nozzle according to the present invention.
Figure 14:
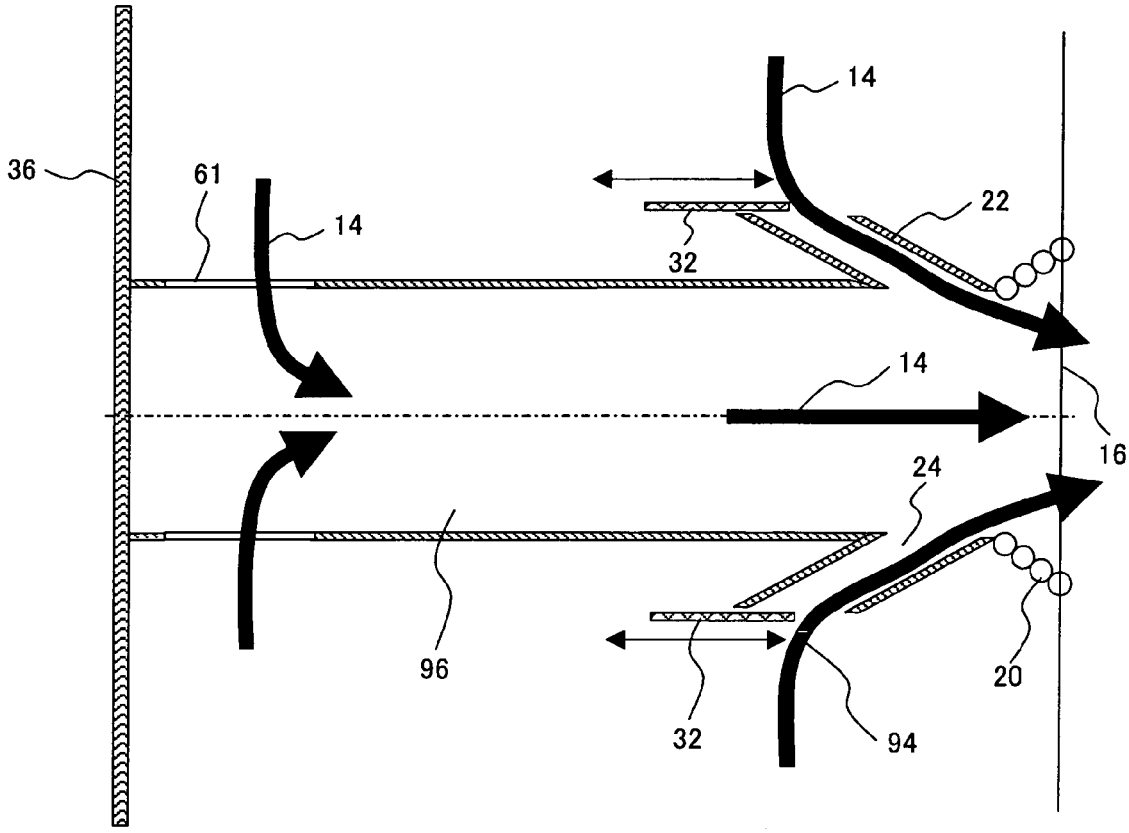
FIG. 14 is a longitudinal cutaway view of an after-air nozzle, showing a variation of the first embodiment of the present invention in FIG. 4.

FIG. 13 is a sectional view showing a further embodiment of an after-air nozzle according to the present invention. This nozzle is of a twin-nozzle structure with a contraction nozzle 94 and a rectilinear nozzle 96. This structure simplifies cooling since an object is absent centrally in the after-air nozzle. A slide ring 32 is moved in its longitudinal direction to change an exit of a vena contracta 24 in minimum flow passage area. FIG. 17 shows a variation of FIG. 16, in which variation, an installation position of a slide ring 32 is changed.

Combustion experiments were performed to verify the advantageous effects of the present invention. The verifications were performed on an after-air nozzle that resembled one of the nozzles of FIG. 1 in terms of construction. Experiments were also conducted using the following five types of nozzles as subjects of comparison:

(1) Nozzle, although similar to the nozzle in FIG. 1, unchangeable in flow passage area of a vena contracta(Contraction nozzle 1)

(2) Nozzle, although similar to the nozzle in FIG. 5, unchangeable in flow passage area of a vena contracts (Contraction nozzle 2)

(3) Rectilinear/rotary nozzle (Rectilinear/rotary nozzle)

(4) Rectilinear nozzle (Rectilinear nozzle 1)

(5) Rectilinear nozzle changeable in flow passage area (Rectilinear nozzle 2)

The rectilinear/rotary nozzle uses a rotary blade to give a swirl to a flow of air at the outer peripheral side. The rectilinear nozzle 1 having only a primary air nozzle is an example of one of the simplest nozzle constructions. The rectilinear nozzle 2 is of a multiple-tubed nozzle unit structure, which allows flow passage areas of various air nozzles to be modified by opening/closing a damper provided at an entrance of each nozzle. This nozzle structure, although substantially the same as those of the present invention in that the flow passage area can be changed, differs in a configuration of a flow passage. In the rectilinear nozzle 2, an outside diameter of the air flow passage changes when the flow passage area is changed.

Results of the verification experiments are shown in FIG. 15. During the experiments, each nozzle was compared in independent nozzle performance with a fuel supply rate, an air supply rate, and a burner section—entire furnace air ratio being kept constant as far as possible. Performance was evaluated in terms of NOx and CO concentrations in furnace exit gas emissions. The NOx concentrations were compared on a 6% O2 conversion basis, and the CO concentrations were compared on a 3% O2 conversion basis.

The NOx and CO reduction performance data obtained using the five types of nozzles as the subjects of comparison, stays approximately between broken lines 108 and 109. Performance with the nozzle of the present invention, however, exhibits the data denoted by a curve 107. The CO concentration can be reduced significantly in the construction of the present invention. In terms of the best NOx reduction performance data obtained, the construction of the present invention is also superior to those of the compared nozzles. These results indicate that the construction of the present invention can reduce NOx and CO at the same time.

Reference number 102 denotes results on the contraction nozzle 1, and 103 denotes results on the contraction nozzle 2. In terms of NOx and CO reduction performance, these nozzles are not excellent over the other compared nozzles. The performance occasionally is rather inferior. These indicate that simultaneous reduction in NOx and CO concentrations cannot be realized just by forming the flow passage into the shape having a vena contracta.

Reference number 104 denotes results on the rectilinear nozzle 2. In terms of NOx and CO reduction performance, this nozzle is not too excellent over the other compared nozzles unchangeable in flow passage area. Although CO can be reduced in comparison with that of the rectilinear nozzle 1, an increase in NOx is observed at this time. Although either NOx or CO reduction performance can be improved by changing the flow passage area, simultaneous reduction in NOx and CO concentrations cannot be attained just by adopting this construction.

Reference number 106 denotes results on the rectilinear nozzle 1. A jetting port of this nozzle has the same bore diameter as that of the nozzle according to the present invention. It is found that merely the bore diameter of the nozzle does not determine NOx and CO reduction performance.

The nozzle of the present invention is found to be superior to the rectilinear nozzle 2 in NOx and CO reduction performance. Comparison results between the contraction nozzles 1, 2 and the nozzle of the present invention, also indicate that for a nozzle with a vena contracta, adopting a construction that allows the flow passage area to be changed yields a significant improvement effect for reduced NOx and CO concentrations.

It is found from the above experimental results that the following requirements on construction must be satisfied to reduce NOx and CO at the same time:

The nozzle must be constructed so as to have a vena contracta in immediate front of the jetting port.

The flow passage of the vena contracta must be changeable.

The cross-sectional area of the air flow passage must be changeable without changing the outside diameter thereof.

Sixth Embodiment

Figure 16:
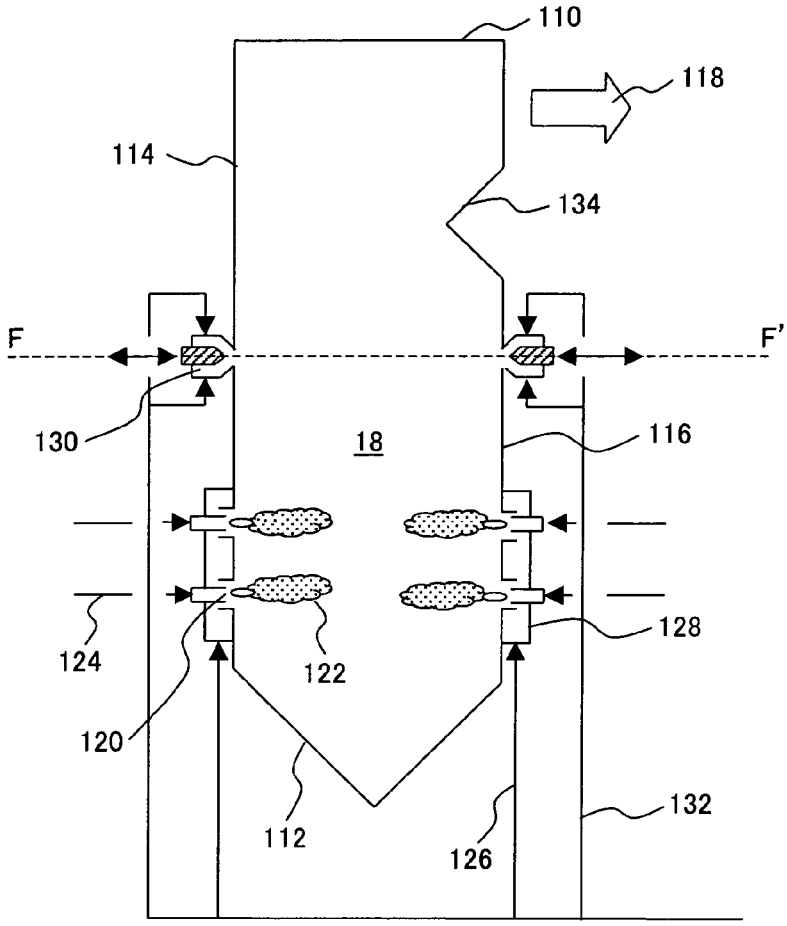
FIG. 16 is a longitudinal cutaway view showing a combustion gas flow direction in a furnace according to a sixth embodiment of the present invention.
Figure 17:
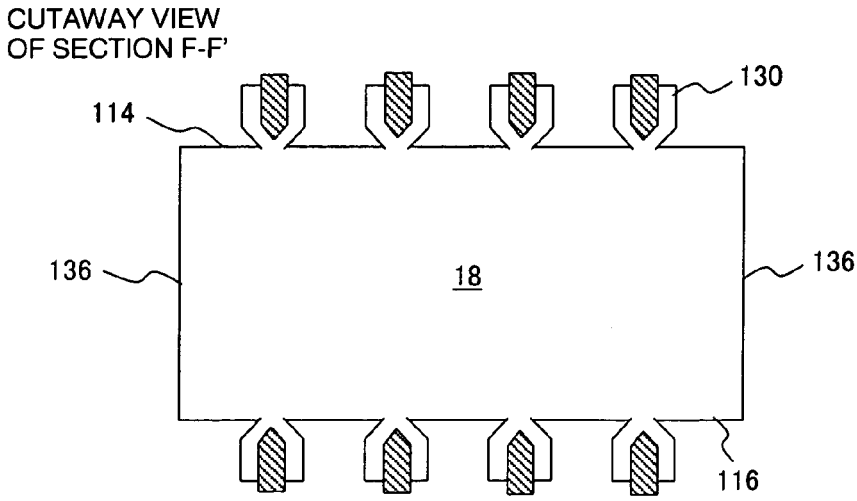
FIG. 17 is a sectional view along line F-F' in FIG. 16.

FIG. 16 shows a further embodiment of an after-air nozzle according to the present invention, and is a configuration diagram of a pulverized-coal combustion furnace which applies an after-air nozzle of the present invention. Walls of this furnace are surrounded by a furnace ceiling 110 at an upper section, a hopper 112 at a lower section, a furnace front wall 114 on a lateral side, a furnace rear wall 116, and furnace sidewalls 136 (shown in FIG. 17). A water tube not shown is installed on the surface of each wall. This water tube absorbs a part of the combustion heat generated in an in-furnace combustion space 18. The combustion gases that have been generated in the in-furnace combustion space 18 flow upward from a downward direction and are discharged as a burnt gas 118. The burnt gas 118 passes through a rear heat-transfer section not shown, and in this section, the heat contained in the gas is further collected.

At a lower portion of the furnace is installed a burner 120, in which a flame 122 short of air is formed. After being crushed into a size of approximately 150 μm or less by a crusher not shown, coal is pneumatically transported and burner primary air and pulverized coal 124 is jetted from the burner into the furnace. At the same time, burner secondary air and tertiary air 126 is also jetted from the burner via a burner windbox 128.

An after-air nozzle 130 is installed above the burner. Part of the air usually supplied as the burner secondary, tertiary air, diverges as after-air 132, which is then jetted from the nozzle 130 into the in-furnace combustion space 18. A nose 134 is provided at an upper section of the furnace rear wall 116. An influence of the nose 134 creates an asymmetrical flow of combustion gas around the after-air nozzle 130.

FIG. 17 is an F-F' sectional view of FIG. 16. The after-air nozzle 130 is usually disposed in plural places at right angles to the flow of the combustion gas. In FIG. 17, two sets of after-air nozzles 130 are arranged. One set is arranged near the furnace sidewalls 136, and the other set is arranged near a central section of the furnace. Because of impacts of the walls, the combustion gas differs in flow state and in temperature, between the side facing the furnace sidewalls 136, and the central side.

Because of these impacts of the nose 134 and furnace sidewalls 136, each of the arranged after-air nozzles 130 is placed under an environment different in flow state and in temperature. For the best possible in-furnace combustion conditions including NOx and CO concentrations, conditions for jetting air from each after-air nozzle 130 are desirably made optimizable according to the environment under which the nozzle is placed.

In the after-air nozzle structure of the present invention, since independent fine adjustment of the flow states inside the vena contracta 24 provided in each after-air nozzle 130 is possible, conditions for jetting air from each after-air nozzle 130 can be kept optimal according to the environment under which the nozzle is placed. The present invention makes it possible to reduce NOx and CO at the same time just by properly modifying the after-air nozzle structure.

Also, in the after-air nozzle structure of the present invention, since a member that defines a minimum flow passage area, namely, a flow passage area-changing element, is provided inside the after-air nozzle, moving the member that defines the minimum flow passage area allows an inside diameter of the vena contracta to be changed with its outside diameter remaining fixed. It is therefore possible to change a cross-sectional area vertical to a central axis of the nozzle, namely, a flow passage cross-sectional area of the vena contracta.

In addition, in the after-air nozzle structure of the present invention, the flow passage cross-sectional area of the vena contracta can be changed by providing the member that defines the minimum flow passage area of the vena contracta , inside the after-air nozzle, and moving the member in the direction of the flow passage. Changing the flow passage cross-sectional area of the vena contracta, therefore, does not require disassembling the after-air nozzle or replacing the member that defines the minimum flow passage area of the vena contracta , with another member; the flow passage cross-sectional area of the vena contracta can be easily changed only by moving the member that defines the minimum flow passage area.

Furthermore, in the after-air nozzle structure of the present invention, since the member defining the minimum flow passage area of the vena contracta is provided inside the after-air nozzle and can be replaced independently, the replacement of the member makes it possible to change the flow passage area of the vena contracta and hence to change the shape of the above member.

Seventh Embodiment

In the present invention, a member that defines a minimum flow passage area of a vena contracta is desirably provided inside a main after-air nozzle. Also, the main after-air nozzle is desirably constituted by a primary and secondary nozzle that supplies a rectilinear or swirling stream of air, and a tertiary nozzle provided outside the primary and secondary nozzle in order to supply tertiary air, wherein a center-directional velocity component directed towards a central axis of a jet of after-air is further desirably bestowed upon the tertiary nozzle. Additionally, there are desirably provided a total air volume controller for the air supplied to the main after-air nozzle and a subsidiary after-air nozzle, and an air volume ratio controller for the air supplied to the main after-air nozzle and the subsidiary after-air nozzle.

Both the main after-air nozzle and the subsidiary after-air nozzle are desirably arranged at plural positions on each of a furnace front wall and furnace rear wall of a boiler. In addition, the subsidiary after-air nozzle is desirably disposed directly above the main after-air nozzle, or downstream between a plurality of main after-air nozzles, or near a furnace sidewall. Other features of the present invention will be more apparent from description of the following embodiments.

Figure 18:
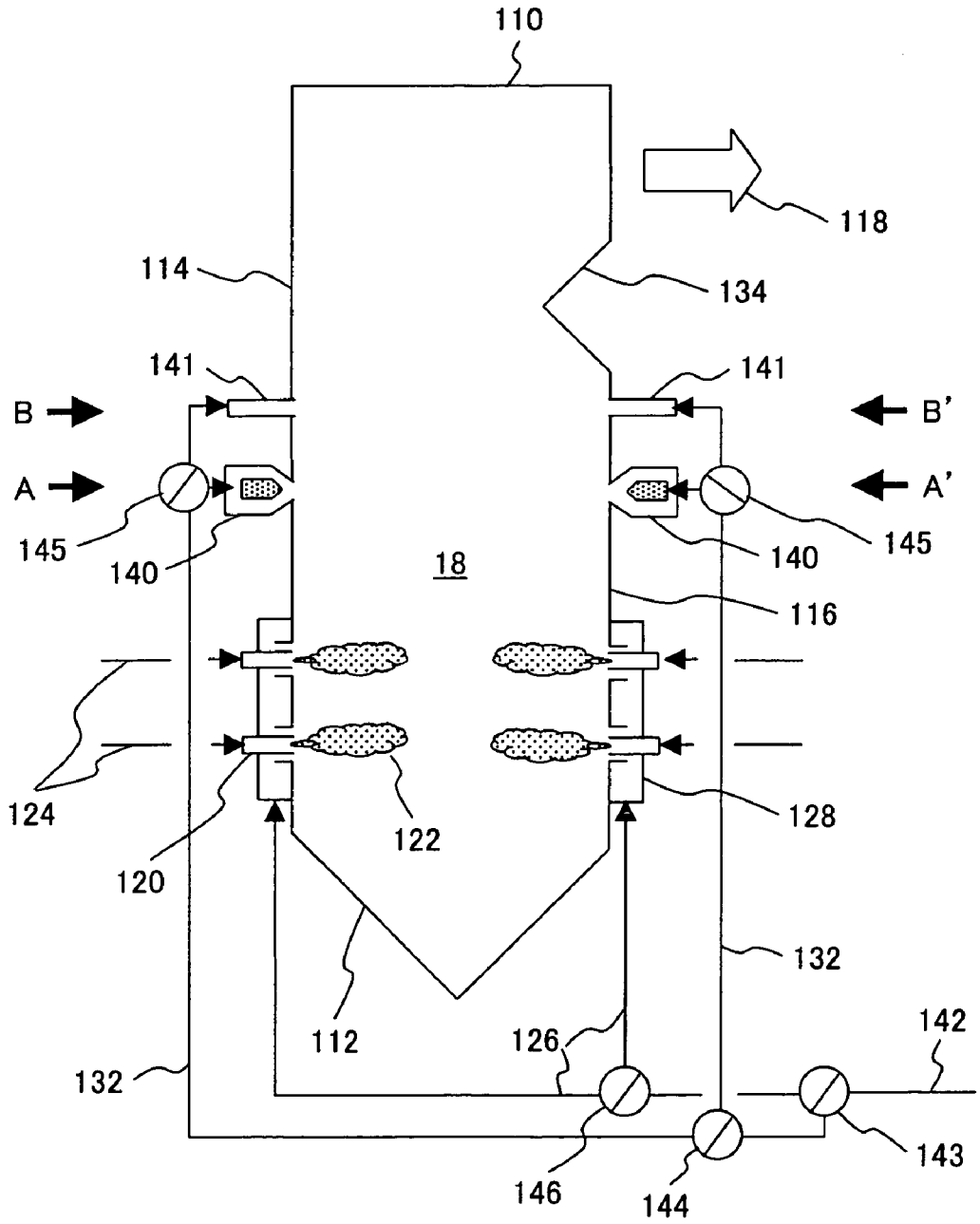
FIG. 18 is a diagram showing a furnace of a pulverized-coal-fired boiler in sectional form, and a supply system of air and pulverized coal, in a further embodiment of the present invention.

FIG. 18 is a configuration diagram of a furnace of a pulverized-coal-fired boiler fueled by pulverized coal as a further embodiment of the present invention. Walls of this furnace are surrounded by a furnace ceiling 110 at an upper section, a hopper 112 at a lower section, a furnace front wall 114 on a lateral side, a furnace rear wall 116, and furnace sidewalls 136 (shown in FIG. 20). A water tube not shown is installed on the surface of each wall. This water tube absorbs a part of the combustion heat generated in an in-furnace combustion space 18. The combustion gases that have been generated in the in-furnace combustion space 18 flow upward from a downward direction and are discharged as a burnt gas 118. The burnt gas 118 passes through a rear heat-transfer section not shown, and in this section, the heat contained in the gas is further collected.

At a lower portion of the furnace is installed a burner 120, in which a flame 122 short of air is formed. The burner 120 includes a pulverized-coal nozzle that jets a mixed stream 124 of burner primary air and pulverized coal, and a secondary nozzle that jets burner secondary air, and a tertiary nozzle that jets tertiary air. The coal, after being crushed into a size of approximately 150 μm or less by a crusher not shown, is transported using the burner primary air, and the mixed stream 124 of burner primary air and pulverized coal is jetted from the burner 120 into the furnace. At the same time, the burner secondary, tertiary air 126 is also jetted from the burner 120 via a burner windbox 128.

A main after-air nozzle 140 is installed above the burner 120. A subsidiary after-air nozzle 141 is installed at the downstream side of the main after-air nozzle 140. The main after-air nozzle 140 is of a contraction-type structure with a stream of air oriented in a direction of a central axis of the main after-air nozzle. Details of the structure will be described later per FIGS. 19 and 21. A large portion of the CO and other unburnt components that have stemmed from the air-short flame 122 formed by the burner is completely burnt (oxidized) by being mixed with the air supplied from the main after-air nozzle. However, NOx occurs when the unburnt components and main after-air are mixed. The NOx is mainly thermal NOx. The amount of NOx occurring has a relationship with a velocity (maximum velocity of a vena contracta) of the air jetted from the main after-air nozzle, and it is important that the velocity of the main after-air be adjusted. Additionally, if jetting conditions for the main after-air are set for a reduction in the NOx, since insufficient oxidation tends to make CO easily occur, the jetting conditions for the main after-air need to be set with careful attention being paid to an NOx-CO performance balance.

Combustion air 142 is distributed into burner secondary, tertiary air 126 and after-air 132 by an air flow rate distribution controller 143. The after-air 132 is further distributed into the air that flows into an after-air circuit provided at the front-wall side, and the air that flows into an after-air circuit provided at the rear-wall side, by an air flow rate distribution controller 144. A nose 134 is usually provided at an upper section of the furnace rear wall 116. An influence of the nose 134 creates an asymmetrical flow of combustion gas around the subsidiary after-air nozzle 141. Even in an asymmetrical flow field, NOx and CO can be reduced by controlling a distribution ratio of the after-air flowing into the front-wall side and the rear-wall side.

The after-air 132 further controls the amount of air supplied from the main/subsidiary after-air nozzle, by means of a main/subsidiary after-air flow rate distribution controller 145. The jetting velocity (maximum velocity of the vena contracta ) of the main after-air can thus be controlled. When the jetting velocity is too high, the subsidiary after-air flow rate is increased, and when the jetting velocity is too low, the opposite is conducted. At this time, the subsidiary after-air is also changed in jetting velocity. Compared with the main after-air, however, the subsidiary after-air jetted from the subsidiary after-air nozzle is low in gas temperature and in flow rate, so any effects upon the occurrence of NOx (thermal NOx) are insignificant. Also, since the main after-air flow rate can be controlled by flow control of the subsidiary after-air, the flow rate of the secondary, tertiary air supplied to the burner can always be kept constant. This means that combustion conditions for the air-short flame 122 formed by the burner can always be operated under the optimum conditions that minimize the amount of NOx occurring at the burner.

As a result, the amount of NOx occurring at the burner can always be maintained at a minimum level. At the same time, the air-jetting conditions for the main after-air nozzle can also be maintained for optimum NOx and CO overall reduction performance.

As with the after-air 132, the secondary, tertiary air 126 supplied to the burner is distributed into the air that flows into the burner section provided at the front-wall side, and the air that flows into the burner section provided at the rear-wall side, by an air flow rate distribution controller 146.

Figure 19:
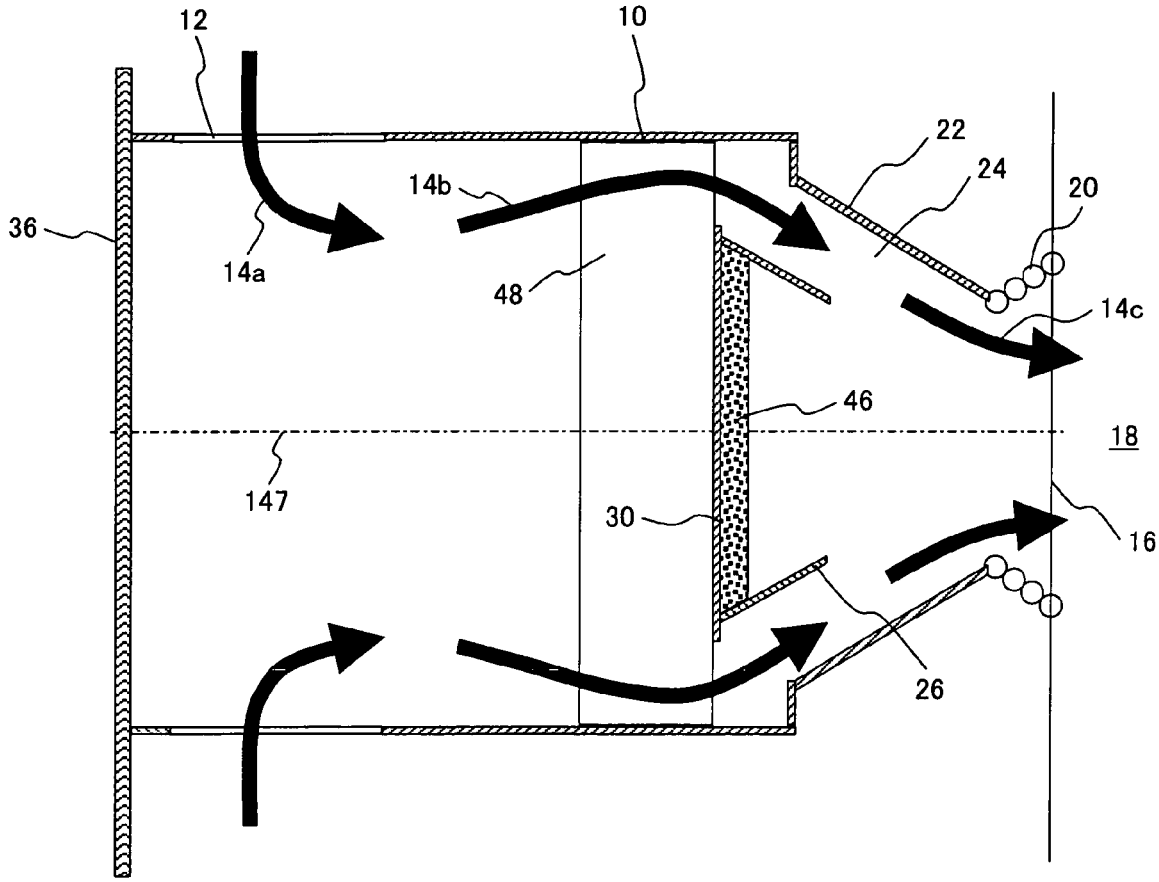
FIG. 19 is a sectional view showing a construction of, and a flow direction of air in, a main after-air nozzle according to a further embodiment of the present invention.

FIG. 19 is a sectional view showing an example of a detailed structure of a main after-air nozzle. The main after-air nozzle in FIG. 19 is of a cylindrical shape with a jet stream central axis 147 as a symmetrical axis. The nozzle is surrounded with a windbox outer casing 10 and a windbox outer wall 36, and air for combustion flows in from a windbox opening 12 as denoted by an arrow 14*a*. The air flows in a direction of the arrow 14*a*, 14*b* and is jetted from a jetting port 16 into an in-furnace combustion space 18. Jetted air mixes with a flammable gas inside the in-furnace combustion space 18 and burns the flammable gas. A water tube 20 is provided around the jetting port 16. The after-air nozzle has a contraction member 22 at the side facing the jetting port 16. The contraction member 22 is constructed so as to have an outside diameter is diminished progressively towards the jetting port 16. A velocity component for a flow towards a central axis of the nozzle is assigned from the contraction member 22 to the flow of air that is indicated by the arrow 14*a*, 14*b* and thus a vena contracts 24 is formed. A member 26 that defines a minimum flow passage area of the vena contracta 24 is provided near an entrance thereof. A velocity of the air in the vena contracta 3 is defined by an area of a section whose opening area is minimized in the vena contracta. In the construction that FIG. 19 shows, the velocity of the vena contracta 24 is maximized at a front end of the member 26 that defines the minimum flow passage area of the vena contracta. The member 26 defining the minimum flow passage area of the vena contracta in FIG. 19 is constructed so as to have an outside diameter gradually diminished towards the jetting port 16. This construction minimizes any disturbances of the flow inside the vena contracta 24. Fewer disturbances make it easier to suppress sudden increases in NOx. The member 26 defining the minimum flow passage area of the vena contracta is secured to a support member 30. The support member 30 is secured to the windbox outer casing 10 via a guide 48. An overheat-preventing member 46 is provided inside the member 26 that defines the minimum flow passage area of the vena contracta. The overheat-preventing member 46 prevents the support member 30 from becoming thermally damaged by the heat radiated from a flame formed in the in-furnace combustion space 18. The overheat-preventing member 46 is not always necessary if the radiant heat from the flame formed in the in-furnace combustion space 18 is sufficiently weak or if the support member 30 can be cooled using any other method.

Figure 20A:
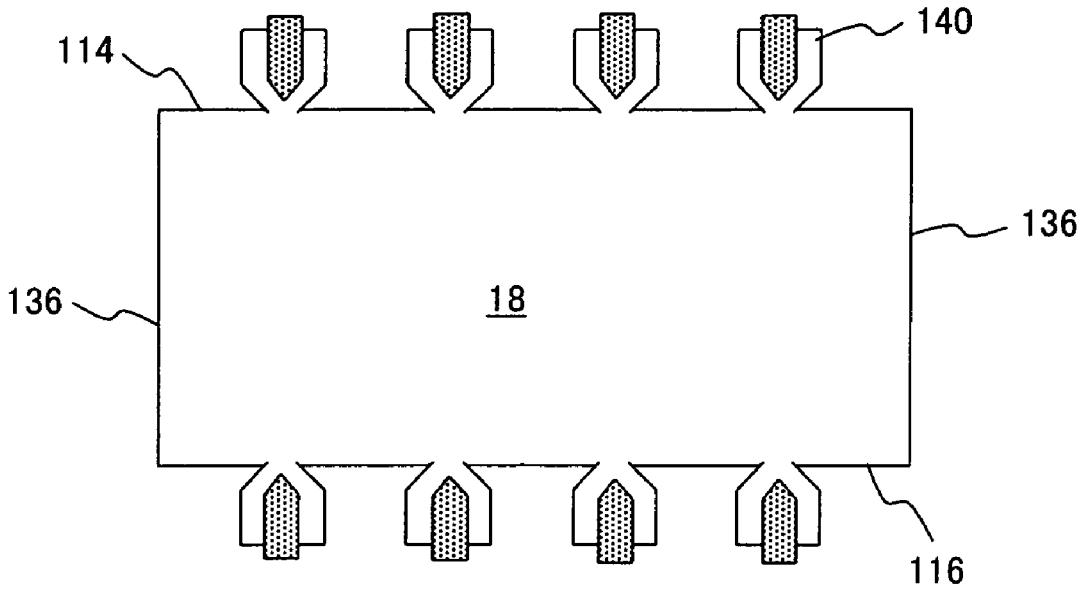
FIGS. 20A, 20B show an example of layout of main after-air nozzles and subsidiary after-air nozzles in the present invention.
Figure 20B:
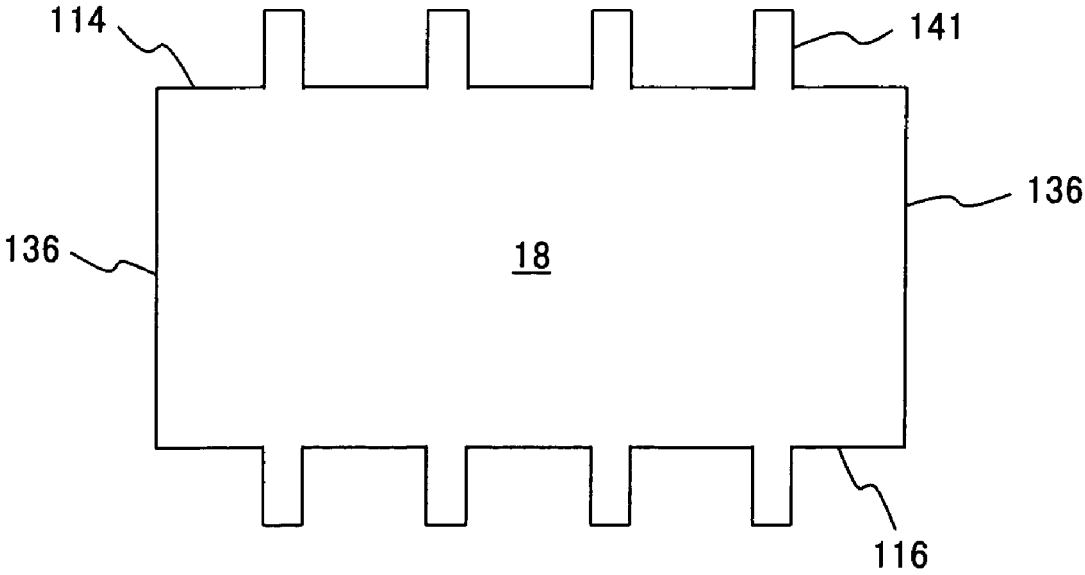

FIGS. 20A and 20B show an example of layout of main after-air nozzles and subsidiary after-air nozzles. FIG. 20A is an A-A' sectional view of FIG. 18, showing the layout of main after-air nozzles 140. FIG. 20B is a B-B' sectional view of FIG. 18, showing the layout of subsidiary after-air nozzles 141. The plural main after-air nozzles 140 are usually arranged at right angles to or substantially at right angles to streams of burner combustion gases, and are arranged in the same numbers at the side facing a furnace front wall 114 and at the side facing a furnace rear wall 116. One of the simplest methods of arranging the subsidiary after-air nozzles 141 is by arranging them directly above the main after-air nozzles 140.

Next, a description will be given of variations of a main after-air nozzle structure and variations of an after-air nozzle layout. It is to be understood, however, that the present invention is not limited to these variations.

[First Variation of a Main After-Air Nozzle Structure]

FIG. 6 or FIG. 8 can be used to illustrate a variation of a detailed structure of a main after-air nozzle.

[Second Variation of a Main After-Air Nozzle Structure]

Figure 21:
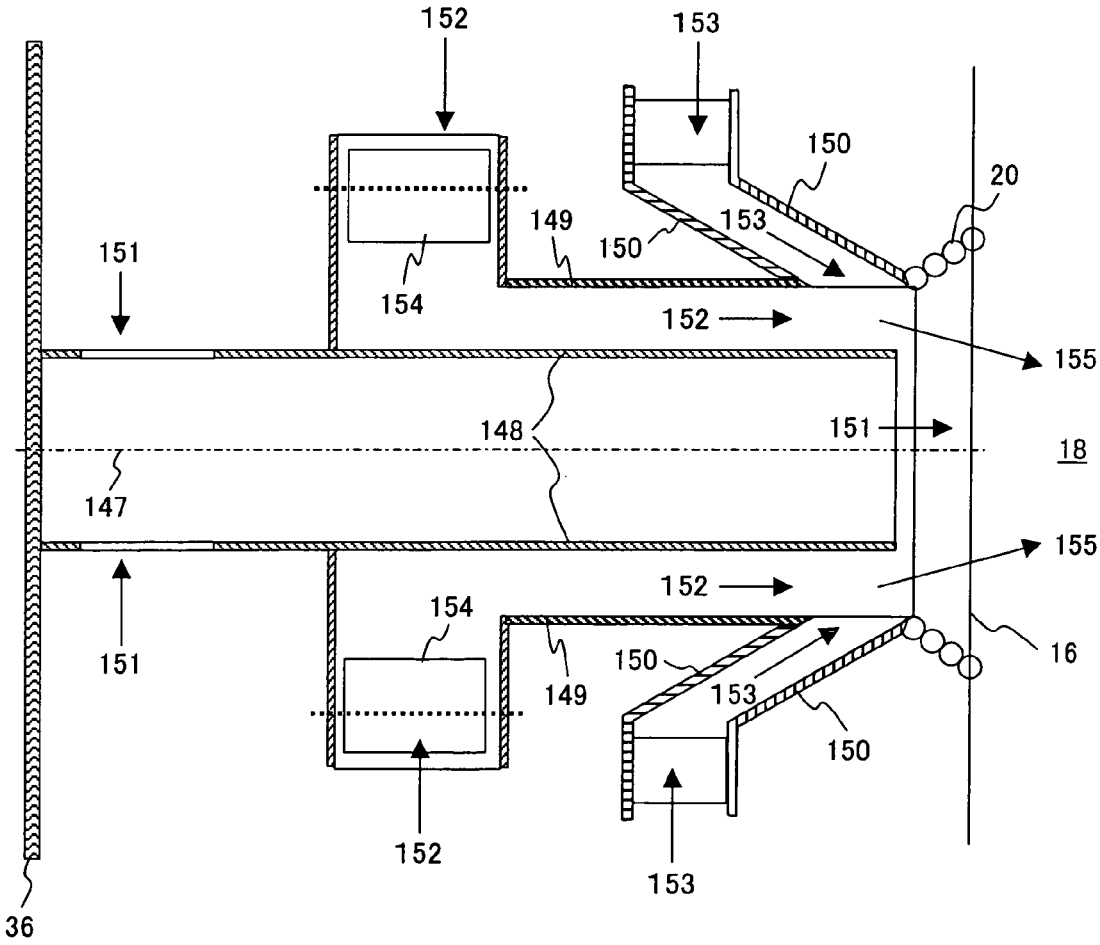
FIG. 21 is a sectional view showing a main after-air nozzle in a further example of the present invention.

FIG. 21 is a sectional view showing another variation of a main after-air nozzle. A primary nozzle 148 is installed centrally in the main after-air nozzle, a secondary nozzle 149 is installed outside the primary nozzle 148, and a contraction tertiary nozzle 150 is installed outside the secondary nozzle 149. In the main after-air nozzle of this structure, primary air flows in the direction indicated by an arrow 151, and secondary air flows outside the primary nozzle, in the direction indicated by an arrow 152. The tertiary air jetted from-the contraction tertiary nozzle 150 flows in the direction indicated by an arrow 153, then at an exit of the secondary nozzle 149, flows together with the stream of the secondary air, indicated by the arrow 152, and flows into an in-furnace combustion space 18. A jetting direction of the secondary nozzle 149 during this phase is parallel to a jet stream central axis 147. Swirling force is further given from a secondary air register 154 to the flow of the secondary air, indicated by the arrow 152. The contraction tertiary nozzle 150 can form a contraction since the nozzle 150 is installed facing the jet stream central axis 147.

Pulverized coal contains ashes. In this case, if a contraction is formed at an exit of the main after-air nozzle, the ashes that have been fused in high-temperature combustion gases may stick to vicinity of a water tube 20 at an exit of an air port. If the sticking ashes grow to form a clinker, this is likely to impede flow or to cause damage to the water tube due to a drop of the clinker. In such cases, reducing a flow rate of the tertiary air before the clinker grows, and increasing a flow rate of the secondary air in order to reduce the clinker in temperature will generate a thermal stress to flake off the clinker.

[First Variation of After-Air Nozzle Layout]

In the present first variation, subsidiary after-air nozzles 141 are arranged downstream between main after-air nozzles 140. The unburnt components that pass between the main after-air nozzles 140 are liable to increase CO emissions, since the unburnt components are prone to be discharged from an associated furnace without mixing with the air jetted from the main after-air nozzles 140. Accordingly, arranging the subsidiary after-air nozzles 141 downstream between the main after-air nozzles 140 facilitates CO reduction since the air jetted from the subsidiary after-air nozzles 141 easily become mixed with the unburnt components that flow through between the main after-air nozzles 140.

[Second Variation of After-Air Nozzle Layout]

In the present second variation, a subsidiary after-air nozzle 141 is disposed in neighborhood of a furnace sidewall 136. When unburnt components pass between a main after-air nozzle 140 and the furnace sidewall 136, CO is most likely to occur, because a gas temperature near the furnace sidewall 136 is low and thus because oxidation rates of CO and of the unburnt components are minimized at the furnace sidewall 136. For this reason, the subsidiary after-air nozzle 141 is disposed near the furnace sidewall 136 in order to achieve highly efficient oxidation of the unburnt components that pass between the main after-air nozzle 140 and the furnace sidewall 136. The disposition of the subsidiary after-air nozzle 141 in closer proximity to the furnace sidewall 136 than to the main after-air nozzle 140 makes it possible to reduce CO, since the disposition facilitates the oxidation of the unburnt components that have passed between the main after-air nozzle 140 and the furnace sidewall 136.

[Verification of Advantageous Effects of the Present Invention]

Figure 22:
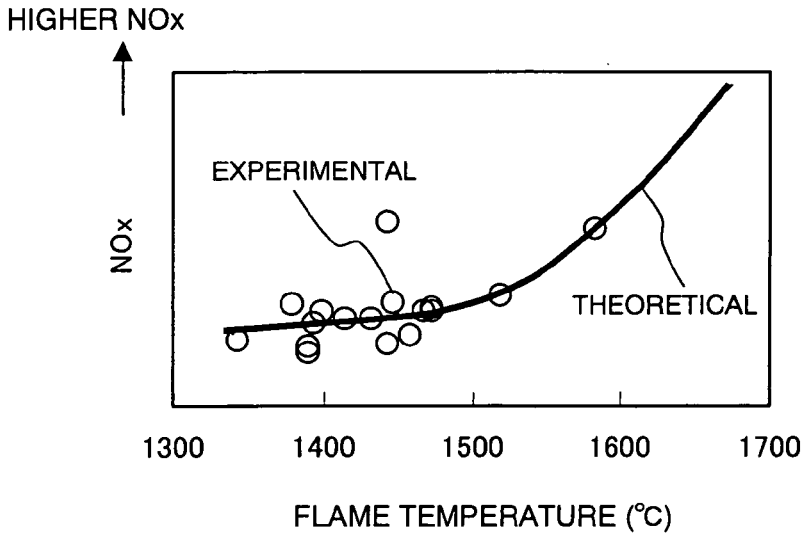
FIG. 22 is a diagram showing a relationship between a flame temperature in an after-air combustor and the amount of NOx occurring therein.

FIG. 22 shows the results representing the relationship between a flame temperature and the amount of NOx occurring. The flame temperature is the maximum temperature attained in the region where the unburnt components that stemmed from a flame short of air, and the air that was jetted from the main after-air, become mixed to burn. Experimental results are marked with a circle in FIG. 22, and theoretical results are represented as a curve. There is a close correlation between NOx and the flame temperature. When the flame temperature increases, NOx increases exponentially. In particular, when the flame temperature exceeds 1500° C., NOx increases significantly.

Figure 23:
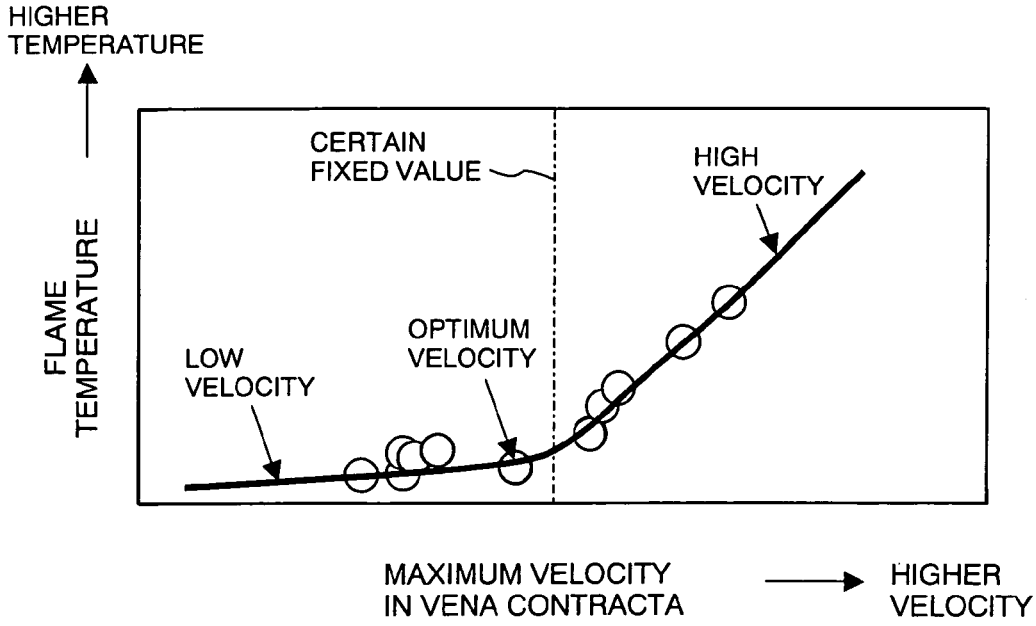
FIG. 23 is a diagram showing a relationship between a velocity of a vena contracta and a flame temperature, in an after-air nozzle according to an embodiment of the present invention.

FIG. 23 shows experimental study results on the relationship between the maximum velocity of the vena contracts and the flame temperature by using the main after-air nozzle constituted in FIG. 19. These results were obtained when a furnace air ratio was varied with a burner air ratio kept substantially constant in a ±2% range of reference conditions. Increases in the maximum velocity of the vena contracta gradually increase the flame temperature. When the maximum velocity of the vena contracta exceeds a fixed value, the flame temperature suddenly increases. This means that although NOx slowly increases before the maximum velocity of the vena contracta reaches the fixed value, NOx abruptly increases once the fixed value has been exceeded. Conversely, CO decreases with increases in the maximum velocity of the vena contracta.

When the maximum velocity of the vena contracta is low, although the NOx concentration is low, the CO concentration is high. Conversely, when the maximum velocity of the vena contracta is too high, although the CO concentration is low, the NOx concentration increases abruptly. Before the velocity reaches a fixed value, CO decreases with increases in the velocity. However, since NOx increases slowly, NOx and CO reduction performance improves as the maximum velocity of the vena contracta increases.

Figure 24:
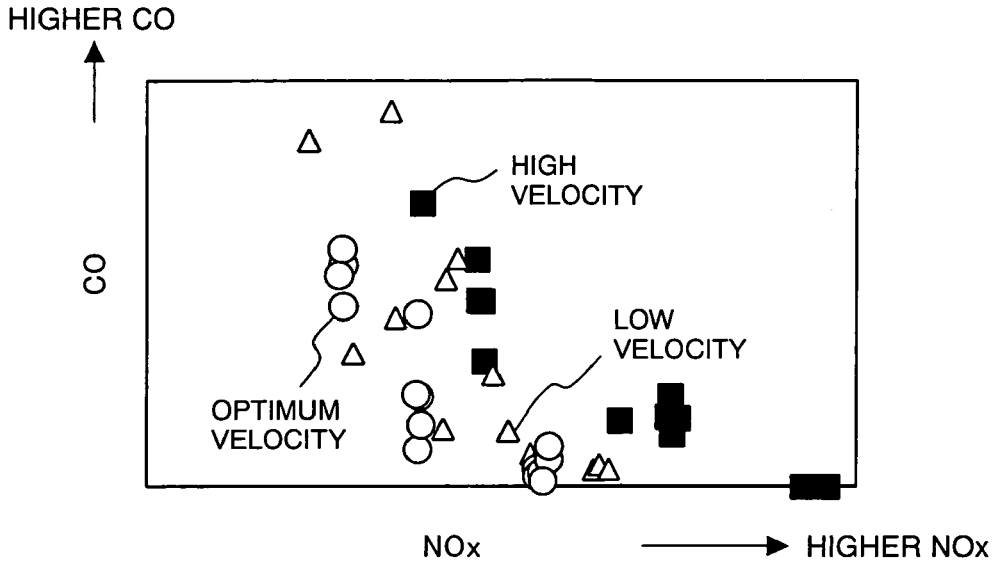
FIG. 24 is a diagram that shows relationships between NOx and CO under different conditions of a velocity of a vena contracta.

FIG. 24 shows measurement results on the relationships between NOx and CO under three different conditions. One is when the vena contracta is slow (low velocity), one is when the vena contracta is optimal (optimum velocity), and one is when the vena contracta is fast (high velocity). The optimum condition is established before a fixed value is reached, and NOx and CO overall reduction performance becomes best at that time. The NOx and CO overall reduction performance decreases, regardless of whether the velocity is higher than the optimum velocity or lower than this.

Figure 25:
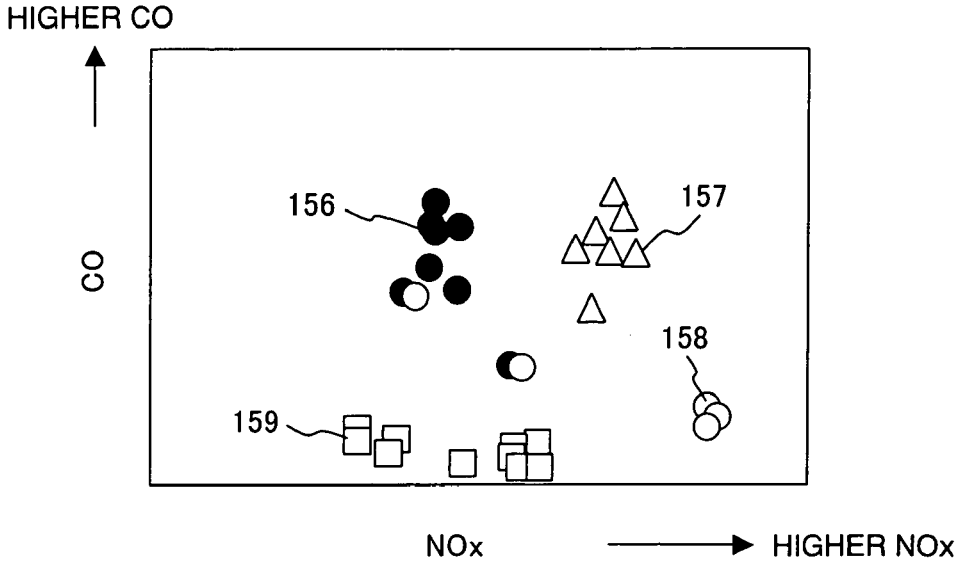
FIG. 25 is a diagram in which the relationship in characteristics between NOx and CO in the present invention is shown for comparison with data in a conventional technique.

FIG. 25 shows NOx and CO comparison results on use of the main after-air nozzle construction shown in FIG. 19, and on use of a main after-air nozzle construction based on a conventional technique. Adopted burner air ratio and furnace air ratio both range within ±2% of reference conditions. In the nozzle construction based on the conventional technique, the contraction tertiary nozzle 150 is removed from the construction shown in FIG. 21. Reference number 156 denotes the results obtained when a swirl is not given to the secondary nozzle included in the conventional construction. Reference number 157 denotes the results obtained when a swirl is given to the secondary nozzle included in the conventional construction. Reference number 158 denotes the results obtained when the nozzle is changed in bore diameter. Reference number 159 denotes the results obtained in the nozzle construction of the present invention (FIG. 19), that is, the results obtained at the optimized maximum velocity of the vena contracta. It is seen that in the construction of the present invention, both NOx and CO are reduced in comparison with the construction based on the conventional technique. It is desirable that such a contraction type of main after-air nozzle structure as shown in FIGS. 19 and 21 be adopted and that the velocity of the vena contracta be optimized.

Figure 26:
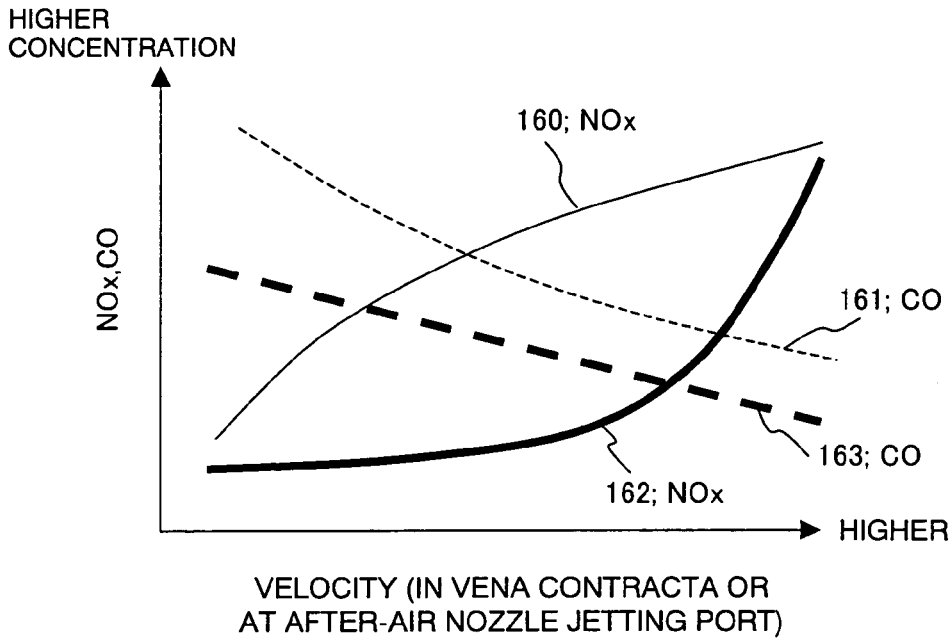
FIG. 26 is a diagram that shows the relationship between a velocity of after-air and NOx and CO concentrations, plotted for comparison between a nozzle construction in the present invention and a construction based on a conventional technique.

In FIG. 26, the relationship between the velocity of the main after-air and the concentrations of NOx and CO is shown for comparison with the conventional technique. In this figure, the velocity in the conventional technique refers to the velocity at the after-air jetting port. The velocity in the present invention is the maximum velocity of the vena contracts. Reference number 160 denotes NOx concentrations based on the conventional technique, and reference number 161 denotes CO concentrations based on the conventional technique. Reference number 162 denotes NOx concentrations based on the present invention, and reference number 163 denotes CO concentrations based on the present invention.

When the velocity increases, NOx increases, whereas CO decreases. This tendency is seen in both the present invention and the conventional technique. The present invention differs from the conventional technique in that until the velocity has reached a fixed value, NOx gently increases. For this reason, NOx and CO overall reduction performance needs to be optimized under certain velocity conditions. In the conventional technique, an increase rate of NOx due to increases in the velocity is high, even under relatively low velocity conditions. Therefore, NOx and CO overall reduction performance does not change too significantly, even when the velocity is varied.

Figure 27:
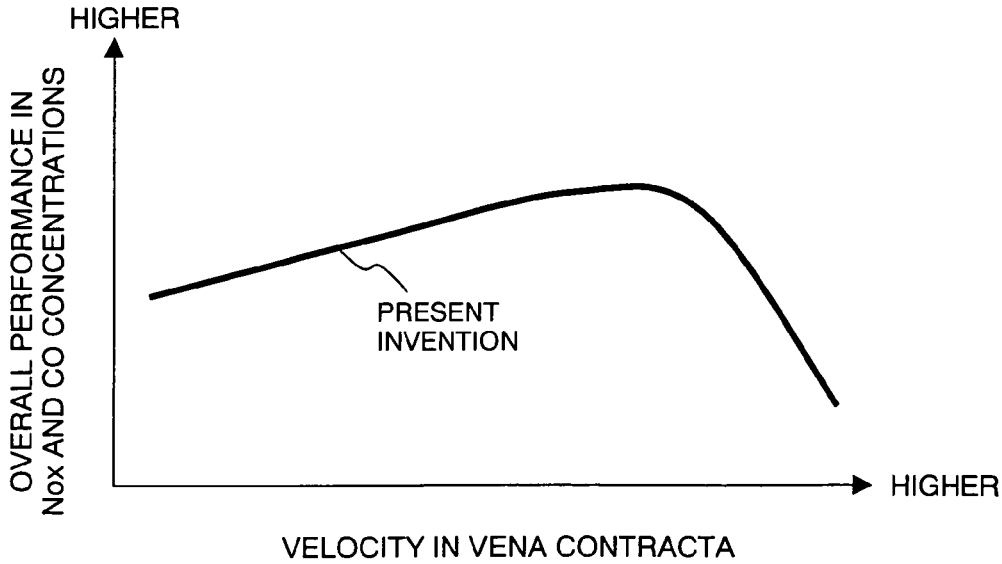
FIG. 27 is a diagram showing the relationship between a velocity of a vena contracta and overall reduction performance for NOx and CO, obtained during use of an after-air nozzle according to an embodiment of the present invention.

FIG. 27 relates to the present invention, and is a diagram showing the relationship between the velocity of the vena contracta and NOx and CO overall reduction performance. Setting the velocity to an optimum value allows simultaneous reduction of NOx and CO. If the velocity exceeds the optimum value, however, this suddenly increases NOx and hence reduces NOx and CO overall reduction performance suddenly. To improve the performance, the velocity must always be kept close to the optimum value. To this end, it is effective to always maintain the vena contracta velocity inside the main after-air nozzle at the optimum value by providing a subsidiary after-air nozzle and adjusting the amount of air to be released thereto. Also, since this method makes it possible to control the vena contracta velocity inside the main after-air nozzle without changing the amount of air to be supplied to be burner, the combustion conditions in the burner section can always be maintained in the optimum state that minimizes the amount of NOx occurring. Using this method to change the vena contracta velocity inside the main after-air nozzle, however, also simultaneously changes the jetting rate of the air supplied from the subsidiary after-air nozzle. The subsidiary after-air nozzle is desirably modified for minimum effects of this change upon NOx.

Figure 28:
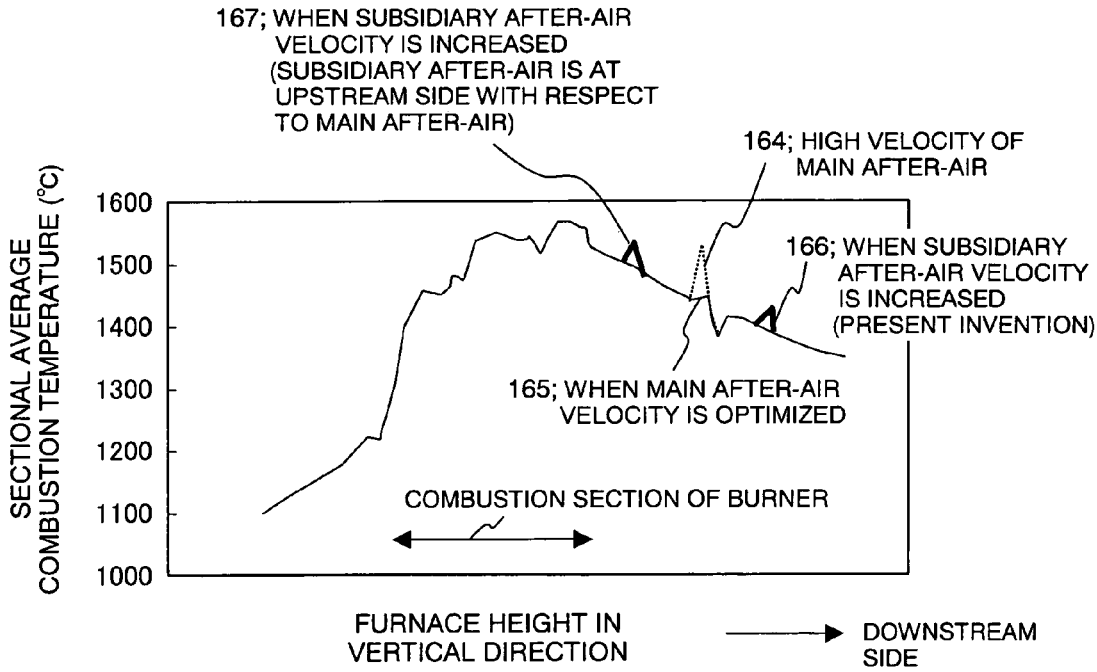
FIG. 28 is a diagram showing an example of calculation results for verification of advantageous effects of the present invention.

Calculated in-furnace temperature distributions are based on study results of the effects caused to methods of disposing the subsidiary after-air nozzle. FIG. 28 shows an example of temperature changes in a direction of furnace height. Temperature is a sectional average value. Broken line 164 indicates temperatures at which the vena contracta maximum velocity of the main after-air nozzle is high. In this case, NOx increases since the maximal value of the temperature near the main after-air exceeds 1500° C. To reduce NOx, it is necessary to lower the maximal value of the temperature near the main after-air by reducing the amount of air supplied to the main after-air nozzle. Solid line 165 indicates the temperature changes observed when the maximum velocity of the vena contracta is optimized by reducing the amount of air to be supplied to the main after-air nozzle. The maximal temperature value decreases and the amount of NOx occurring near the main after-air can be reduced. In this case, however, reduction in the amount of air supplied to the main after-air nozzle is likely to cause NOx near the subsidiary after-air nozzle, since the amount of air supplied to the subsidiary after-air nozzle increases.

Solid line 166 indicates the temperature changes observed near the subsidiary after-air in the construction of the present invention. The subsidiary after-air nozzle is provided downstream with respect to the main after-air nozzle, so an ambient temperature near the subsidiary after-air nozzle is controlled below 1500° C. by dissipation of heat to the furnace walls. Effects upon the amount of NOx occurring, therefore, are insignificant, even if changes in the velocity of the air jetted from the subsidiary after-air nozzle change the ambient temperature. The amount of NOx generated from the entire furnace can be lessened by reducing the NOx occurring near the main after-air.

Solid line 167 indicates the temperature changes observed near the subsidiary after-air when the subsidiary after-air nozzle is installed upstream with respect to the main after-air nozzle dissimilarly to the construction of the present invention. At this time, air from the subsidiary after-air nozzle is jetted into ambient gases whose temperatures are near 1500° C. Under these conditions, an increase in temperature due to an increase in the air velocity renders NOx liable to increase abruptly. For this reason, the amount of air supplied to the main after-air nozzle is reduced for a reduction in the NOx occurring thereat. The air velocity of the subsidiary after-air nozzle consequently increases, which makes it easy for the occurrence of NOx near the subsidiary after-air nozzle to increase conversely. It is therefore difficult to reduce the NOx generated from the entire furnace.

The NOx and CO overall reduction performance shown in FIG. 27 is defined as the overall performance that improves when both NOx and CO decrease. Therefore, the overall performance decreases, not only when both NOx and CO increase, but also when either thereof increases.

According to the present invention, a boiler is provided that achieves two-stage combustion by equipping a furnace wall with a burner that burns a fuel in a state of air shortage, and with an after-air nozzle by which a complete combustion of the combustion gas generated by the burner is conducted downstream with respect to a flow direction of the combustion gas, wherein the boiler includes: means for adjusting an air flow rate of a main after-air nozzle formed at the uppermost stream end with the after-air nozzle disposed in a plural-stage form in the flow direction of the combustion gas; a vena contracta formed in the main after-air nozzle so that an outside diameter of an air flow passage diminishes towards an air-jetting port; and a member formed inside the main after-air nozzle in order to define a minimum flow passage area of the vena contracta. That is to say, since a velocity of air in the vena contracta is defined by an area of a section whose opening area is minimized in the vena contracta, forming an interior of the main after-air nozzle with the member which defines the minimum flow passage area of the vena contracts makes it possible to arbitrarily set a velocity of the vena contracta according to a particular area of a front end of the member and the air flow rate of the main after-air nozzle.

The present invention also provides a boiler adapted to achieve two-stage combustion by equipping a furnace wall with a burner that burns a fuel in a state of air shortage, and with an after-air nozzle by which a complete combustion of the combustion gas generated by the burner is conducted downstream with respect to a flow direction of the combustion gas, wherein the boiler includes: means for adjusting an air flow rate of a main after-air nozzle formed at the uppermost stream end with the after-air nozzle disposed in a plural-stage form in the flow direction of the combustion gas; and a vena contracta formed in the main after-air nozzle so that an outside diameter of an air flow passage diminishes towards an air-jetting port; and wherein the main after-air nozzle includes a primary nozzle, a secondary nozzle provided externally thereto, and a tertiary nozzle provided further externally thereto, the tertiary nozzle being oriented towards a nozzle central axis, and an air stream jetted from the tertiary nozzle having a center-directional velocity component. Since the air stream jetted from the tertiary nozzle has a center-directional velocity component in this way, intensity of the vena contracta can be adjusted, even without a movable member such as the member defining the minimum flow passage area of the vena contracta.

In addition, the present invention provides a boiler adapted to achieve two-stage combustion by equipping a furnace wall with a burner that burns a fuel in a state of air shortage, and with an after-air nozzle by which a complete combustion of the combustion gas generated by the burner is conducted downstream with respect to a flow direction of the combustion gas, wherein the boiler includes: means for adjusting an air flow rate of a main after-air nozzle formed at the uppermost stream end with the after-air nozzle disposed in a plural-stage form in the flow direction of the combustion gas; and a vena contracta formed in the main after-air nozzle so that an outside diameter of an air flow passage diminishes towards an air-jetting port; and wherein the main after-air nozzle includes a primary nozzle, a secondary nozzle provided externally thereto, and a tertiary nozzle provided further externally thereto, the tertiary nozzle being oriented towards a nozzle central axis, an air stream jetted from the tertiary nozzle having a center-directional velocity component, and the primary nozzle and the secondary nozzle each supplying a rectilinear or swirling stream of air. As shown in FIG. 21, the air stream jetted from the tertiary nozzle has a center-directional velocity component, a stream of tertiary air and a stream of secondary air meet at the exit of the secondary nozzle and then flow together into an in-furnace combustion space. A jetting direction of the secondary is parallel to a jet stream central axis. Intensity of the vena contracta can therefore be adjusted by adjusting, as appropriate, flow rates of the air jetted from the secondary nozzle and the tertiary nozzle. Also, if any ashes fused in high-temperature combustion gases stick to vicinity of a water tube at an exit of an air port and form a clinker, the clinker can be flaked off by adjusting the flow rates of the secondary and tertiary air before the clinker grows.

Furthermore, the present invention provides a boiler adapted to achieve two-stage combustion by equipping a furnace wall with a burner that burns a fuel in a state of air shortage, and with an after-air nozzle by which a complete combustion of the combustion gas generated by the burner is conducted downstream with respect to a flow direction of the combustion gas, wherein the boiler includes: means for adjusting an air flow rate of a main after-air nozzle formed at the uppermost stream end with the after-air nozzle disposed in a plural-stage form in the flow direction of the combustion gas; and a vena contracta formed in the main after-air nozzle so that an outside diameter of an air flow passage diminishes towards an air-jetting port; and wherein the after-air nozzle is provided in a two-stage form. More specifically, the after-air nozzle provided in a two-stage form includes a main after-air nozzle with a vena contracta , at an upstream side (first stage) of the combustion gas flow direction, and a subsidiary after-air nozzle at a downstream side (second stage) thereof. Since the subsidiary after-air nozzle is provided downstream with respect to the main after-air nozzle in this form, an ambient temperature near the subsidiary after-air nozzle is controlled below 1500° C. by dissipation of heat to the furnace wall, as shown in FIG. 28. Effects upon the amount of NOx occurring, therefore, are insignificant, even if changes in the velocity of the air jetted from the subsidiary after-air nozzle change the ambient temperature. The amount of NOx generated from the entire furnace, therefore, can be lessened by reducing the NOx occurring near the main after-air.

Moreover, the present invention provides a boiler adapted to achieve two-stage combustion by equipping a furnace wall with a burner that burns a fuel in a state of air shortage, and with an after-air nozzle by which a complete combustion of the combustion gas generated by the burner is conducted downstream with respect to a flow direction of the combustion gas, wherein the boiler includes: means for adjusting an air flow rate of a main after-air nozzle formed at the uppermost stream end with the after-air nozzle disposed in a plural-stage form in the flow direction of the combustion gas; and a vena contracta formed in the main after-air nozzle so that an outside diameter of an air flow passage diminishes towards an air-jetting port; and wherein the after-air nozzle and other subsidiary after-air nozzles are each arranged at plural positions opposed to a furnace front wall and a furnace rear wall. This arrangement of after-air nozzles at positions opposed to the furnace front wall and the furnace rear wall allows accelerated mixing of combustion since the air streams jetted from the after-air nozzles can be impinged upon one another near a central internal portion of the furnace.

Besides, the present invention provides a boiler adapted to achieve two-stage combustion by equipping a furnace wall with a burner that burns a fuel in a state of air shortage, and with an after-air nozzle by which a complete combustion of the combustion gas generated by the burner is conducted downstream with respect to a flow direction of the combustion gas, wherein the boiler includes: means for adjusting an air flow rate of a main after-air nozzle formed at the uppermost stream end with the after-air nozzle disposed in a plural-stage form in the flow direction of the combustion gas; and a vena contracta formed in the main after-air nozzle so that an outside diameter of an air flow passage diminishes towards an air-jetting port; and wherein the above-mentioned subsidiary after-air nozzles are arranged directly above the main after-air nozzle. The subsidiary after-air nozzles can be easily arranged by disposing each of the subsidiary after-air nozzles directly above the main after-air nozzle.

What is claimed is:

1. An after-air nozzle for a two-stage combustion boiler, comprising:

a windbox outer casing for surrounding an outside of an after-air nozzle, an opening of the windbox provided on the windbox outer casing to flow air for combustion into the after-air nozzle;

a vena contracta adapted such that an outside diameter of a flow passage diminishes towards an air-jetting port which supplies air to the boiler; and a changing apparatus of a flow passage cross-sectional area of the vena contracta, wherein air for combustion flows into the after-air nozzle from the opening of the window, streams through the changing apparatus of the flow passage cross-sectional area and jets into the boiler from the air-jetting port, the changing apparatus of the flow passage cross-section area is provided with a member which defines a minimum flow passage area of the vena contracta in the after-air nozzle, the after-air nozzle further comprising a first slide member for moving the changing apparatus of the flow passage cross-sectional area in a direction of a flow passage so that the flow passage area of the vena contracta can be changed, and a second slide member provided on the windbox outer casing for changing an area of the opening of the windbox for air flowing into the after-air nozzle.

2. The after-air nozzle according to claim 1, wherein the member defining a minimum flow passage area of the vena contracta is adapted to progressively diminish in outside diameter towards the air-jetting port.

3. The after-air nozzle according to claim 1, wherein, when a flow direction of the air that flows inside the after-air nozzle is taken as a reference, a moving range of the member defining a minimum flow passage area of the vena contracta begins at the place where a front end of the member is positioned closer to an upstream side of the flow direction than to a starting position of the vena contracta, and ends at the place where the front end of the member is positioned closer to a downstream side of the flow direction than to the starting position of the vena contracta.

4. A two-stage combustion boiler, comprising;

a furnace for generating a steam by thermal energy of a combustion gas by burning a fuel and air;

a burner provided upstream with respect to a flow direction of the gas in the furnace, wherein the burner burns the fuel under conditions short of air; and an after-air nozzle provided downstream with respect to the flow direction of the gas in the furnace, and downstream with respect to the burner, wherein the nozzle supplies the air required for achieving a complete combustion of the combustion gas;

wherein the after-air nozzle according to claim 1 having is disposed at a plurality of positions in the furnace.

5. A boiler adapted to achieve two-stage combustion by equipping a furnace wall with a burner which burns a fuel in a state of air shortage, and with an after-air nozzle by which a complete combustion of the combustion gas generated by the burner is conducted downstream with respect to a flow direction of the combustion gas, the boiler further comprising:

a main after-air nozzle formed at the uppermost stream end and a subsidiary after-air nozzle formed at the downstream with the after-air nozzle disposed in a plural-stage form in the flow direction of the combustion gas, wherein the main after-air nozzle and the subsidiary after-air nozzle are used as the after-air nozzle according to claim 1.

6. The boiler according to claim 5, wherein the main after-air nozzle includes a primary nozzle, a secondary nozzle provided externally thereto, and a tertiary nozzle provided further externally thereto, and wherein the tertiary nozzle is oriented towards a nozzle central axis, and an air stream jetted from the tertiary nozzle has a center-directional velocity component.

7. The boiler according to claim 6, wherein the primary nozzle and the secondary nozzle each supplies a rectilinear stream or swirling stream of air.

8. The boiler according to claim 5, further including:

an air volume controller to control the total amount of air supplied to the main after-air nozzle and the subsidiary after-air nozzle; and an air ratio controller to control a ratio between the amount of air supplied to the main after-air nozzle and the amount of air supplied to the other subsidiary after-air nozzles.

9. The boiler according to claim 5, wherein the after-air nozzle is provided in a two-stage form.

10. The boiler according to claim 5, wherein the main after-air nozzle and the subsidiary after-air nozzle are each arranged at plural positions opposed to a furnace front wall and a furnace rear wall.

11. The boiler according to claim 10, wherein each of the subsidiary after-air nozzles is arranged directly above each of the main after-air nozzles.

12. The boiler according to claim 10, wherein each of the subsidiary after-air nozzles is arranged downstream between the main after-air nozzles.

13. The boiler according to claim 10, wherein the subsidiary after-air nozzles are each arranged at sidewalls of the boiler.

14. A method of combustion in a boiler adapted to achieve two-stage combustion by equipping a furnace wall with a burner to burn a fuel in a state of air shortage, and with an after-air nozzle having a main after-air nozzle and a subsidiary after-air nozzle to burn a complete combustion of the combustion gas generated by the burner is conducted downstream with respect to a flow direction of the combustion gas, the main after-air nozzle comprising a windbox outer casing for surrounding an outside of an after-air nozzle, an opening of the windbox provided on the windbox outer casing to flow air for combustion into the after-air nozzle, a vena contracta adapted such that an outside diameter of a flow passage diminishes towards an air-jetting port which supplies air to the boiler, a changing apparatus of a flow passage cross-sectional area of the vena contracta provided with a member which defines a minimum flow passage area of the vena contracta in the after-air nozzle, and the after-air nozzle further comprising a first slide member for moving the changing apparatus of the flow passage cross-sectional area in a direction of a flow passage, and a second slide member provided on the windbox outer casing for changing an area of the opening of the windbox, wherein air for combustion flows into the after-air nozzle from the opening of the windbox, streams through the changing apparatus of the flow passage cross-sectional area and jets into the boiler from the air-jetting port, the combustion method comprising the steps of:

adjusting an amount of air flowing into the main after-air nozzle formed at the uppermost stream end with the after-air nozzle and conducting a two-stage combustion of the fuel in the boiler having the vena contracta formed in the main after-air nozzle by moving the first slide member to move the changing apparatus of a flow passage cross-sectional area in the main after-air nozzle so that the flow passage area of the vena contracta can be changed; and adjusting an area of the opening of the windbox for air flowing into the main after-air nozzle by moving the second slide member, so that a total amount of air flowing into the main after-air nozzle can be maintained constant during the two-stage combustion.

* * * * *